US010969727B2

(12) United States Patent
Nagashima

(10) Patent No.: US 10,969,727 B2
(45) Date of Patent: Apr. 6, 2021

(54) FIXING APPARATUS FOR DETERMINING HEAT GENERATION MEMBER TO WHICH ELECTRIC POWER IS BEING SUPPLIED, AND IMAGE FORMING APPARATUS

(71) Applicant: CANON KABUSHIKI KAISHA, Tokyo (JP)

(72) Inventor: Satoru Nagashima, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/812,709

(22) Filed: Mar. 9, 2020

(65) Prior Publication Data

US 2020/0292981 A1 Sep. 17, 2020

(30) Foreign Application Priority Data

Mar. 11, 2019 (JP) ..... JP2019-043987

(51) Int. Cl.
*G03G 15/00* (2006.01)
*G03G 15/20* (2006.01)

(52) U.S. Cl.
CPC ..... *G03G 15/80* (2013.01); *G03G 15/2039* (2013.01)

(58) Field of Classification Search
CPC ..... G03G 15/80; G03G 15/2039; G03G 15/55
See application file for complete search history.

(56) References Cited

U.S. PATENT DOCUMENTS

2009/0074442 A1* 3/2009 Sano ..... G03G 15/80 399/69
2016/0357135 A1* 12/2016 Yamamoto ..... G03G 15/2032

FOREIGN PATENT DOCUMENTS

JP 2001100558 A 4/2001
JP 2004233390 A 8/2004
JP 2011095314 A 5/2011

* cited by examiner

*Primary Examiner* — Sandra Brase
(74) *Attorney, Agent, or Firm* — Venable LLP

(57) ABSTRACT

The fixing apparatus includes a heater including at least two heat generation members, a relay, a triac, a zero-crossing circuit unit connected between a first pole and a second pole of an AC power supply, and configured to output a zero-crossing signal, and a CPU configured to control the relay and the triac, and the CPU determines which one of the at least two heat generation members is the heat generation member to which electric power is being supplied from the AC power supply, based on the zero-crossing signal output from the zero-crossing circuit unit.

23 Claims, 13 Drawing Sheets

FIXING APPARATUS FOR DETERMINING HEAT GENERATION MEMBER TO WHICH ELECTRIC POWER IS BEING SUPPLIED, AND IMAGE FORMING APPARATUS

BACKGROUND OF THE INVENTION

Field of the Invention

The present invention relates to a fixing apparatus and an image forming apparatus, and relates to, for example, the technology of a heat fixing apparatus including a plurality of heat generation members for fixing a toner image formed in an electrophotography process on a recording material.

Description of the Related Art

In a heating apparatus using a ceramic heater for a heat generation source, when a recording sheet (small sized sheet) having a sheet-feeding width shorter than the length of a heat generation member is fed, a phenomenon may occur in which the temperature becomes higher in this heat generation area and a non-sheet-feeding area than in the sheet-feeding area. Hereinafter, this phenomenon is referred to as the non-sheet-feeding portion temperature rising. If the temperature increases due to the non-sheet-feeding portion temperature rising becomes too large, there is a possibility of causing a damage to the surrounding members, such as a member supporting the ceramic heater. Therefore, as in Japanese Patent Application Laid-Open No. 2001-100558, a heating apparatus and an image forming apparatus have been proposed that include a plurality of heat generation members having different lengths, and selectively use the heat generation member having a length corresponding to the width of a recording paper, so as to enable reduction of the non-sheet-feeding portion temperature rising.

However, in conventional examples, in a case where a driving circuit component or an arithmetic apparatus fails, such as a short failure of a triac, there is a possibility of causing another heat generation member, which is different from a heat generation member to be controlled, to generate heat. If electric power is supplied to the heat generation member that is not to be controlled, and heat is generated, there is a possibility that, for example, the non-sheet-feeding portion temperature rising occurs, and a component of the heating apparatus corresponding to the portion whose temperature has risen is thermally destructed.

SUMMARY OF THE INVENTION

An aspect of the present invention is a fixing apparatus configured to fix an unfixed toner image on a recording material, the fixing apparatus including a heater unit including heat generation members at least including a first heat generation member having a first resistance value, and a second heat generation member having a second resistance value larger than the first resistance value, a first switching unit configured to switch connection between one of the first heat generation member and the second heat generation member, and an AC power supply, a second switching unit configured to be switchable between a conduction state in which electric power is supplied to one of the first heat generation member and the second heat generation member from the AC power supply, and a non-conduction state in which supply of electric power supplying to the one of the first heat generation member and the second heat generation member from the AC power supply is cut off, a zero-crossing circuit unit connected between a first pole and a second pole of the AC power supply, the zero-crossing circuit unit configured to output a zero-crossing signal according to an AC voltage of the AC power supply, and a control unit configured to control the first switching unit and the second switching unit, wherein the control unit determines whether the electric power is supplied to the first heat generation member from the AC power supply, or the electric power is supplied to the second heat generation member from the AC power supply, based on the zero-crossing signal output from the zero-crossing circuit unit.

Another aspect of the present invention is a fixing apparatus configured to fix an unfixed toner image on a recording material, the fixing apparatus including a heater unit including heat generation members at least including a first heat generation member having a first resistance value, and a second heat generation member having a second resistance value larger than the first resistance value, a first switching unit configured to switch connection between one of the first heat generation member and the second heat generation member, and an AC power supply, a second switching unit configured to be switchable between a conduction state in which electric power is supplied to one of the first heat generation member and the second heat generation member from the AC power supply, and a non-conduction state in which supply of electric power supplying to the one of the first heat generation member and the second heat generation member from the AC power supply is cut off, a frequency detection circuit unit connected between a first pole and a second pole of the AC power supply, and configured to detect a frequency of an AC voltage of the AC power supply, and a control unit configured to control the first switching unit and the second switching unit, wherein the control unit determines whether the electric power is supplied to the first heat generation member from the AC power supply, or the electric power is supplied to the second heat generation member from the AC power supply, based on the frequency detected from the frequency detection circuit unit.

A further aspect of the present invention is an image forming apparatus including an image formation unit configured to form an unfixed toner image on a recording material, and a fixing apparatus configured to fix an unfixed toner image on a recording material, the fixing apparatus including a heater unit including heat generation members at least including a first heat generation member having a first resistance value, and a second heat generation member having a second resistance value larger than the first resistance value, a first switching unit configured to switch connection between one of the first heat generation member and the second heat generation member, and an AC power supply, a second switching unit configured to be switchable between a conduction state in which electric power is supplied to one of the first heat generation member and the second heat generation member from the AC power supply, and a non-conduction state in which supply of electric power supplying to the one of the first heat generation member and the second heat generation member from the AC power supply is cut off, a zero-crossing circuit unit connected between a first pole and a second pole of the AC power supply, the zero-crossing circuit unit configured to output a zero-crossing signal according to an AC voltage of the AC power supply, and a control unit configured to control the first switching unit and the second switching unit, wherein the control unit determines whether the electric power is supplied to the first heat generation member from the AC power supply, or the electric power is supplied to the second heat generation member from the AC power supply, based on the zero-crossing signal output from the zero-crossing circuit unit.

A further aspect of the present invention is an image forming apparatus including an image formation unit configured to form an unfixed toner image on a recording material, and a fixing apparatus configured to fix an unfixed toner image on a recording material, the fixing apparatus including a heater unit including heat generation members at least including a first heat generation member having a first resistance value, and a second heat generation member having a second resistance value larger than the first resistance value, a first switching unit configured to switch connection between one of the first heat generation member and the second heat generation member, and an AC power supply, a second switching unit configured to be switchable between a conduction state in which electric power is supplied to one of the first heat generation member and the second heat generation member from the AC power supply, and a non-conduction state in which supply of electric power supplying to the one of the first heat generation member and the second heat generation member from the AC power supply is cut off, a frequency detection circuit unit connected between a first pole and a second pole of the AC power supply, and configured to detect a frequency of an AC voltage of the AC power supply, and a control unit configured to control the first switching unit and the second switching unit, wherein the control unit determines whether the electric power is supplied to the first heat generation member from the AC power supply, or the electric power is supplied to the second heat generation member from the AC power supply, based on the frequency detected from the frequency detection circuit unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention will be described later with reference to the drawings. In the following embodiments, it is referred to as sheet feeding to feed a sheet through a fixation nip portion. Additionally, in an area where a heat generation member is generating heat, an area where sheet feeding of a sheet is not performed is referred to as a non-sheet-feeding area (or the non-sheet-feeding portion), and an area where sheet feeding of a sheet is performed is referred to as a sheet-feeding area (or the sheet-feeding portion). Further, a phenomenon in which the temperature of the non-sheet-feeding area becomes higher compared with the temperature of the sheet-feeding area is referred to as the non-sheet-feeding portion temperature rising.

Embodiment 1

Image Forming Apparatus

Figure 1:
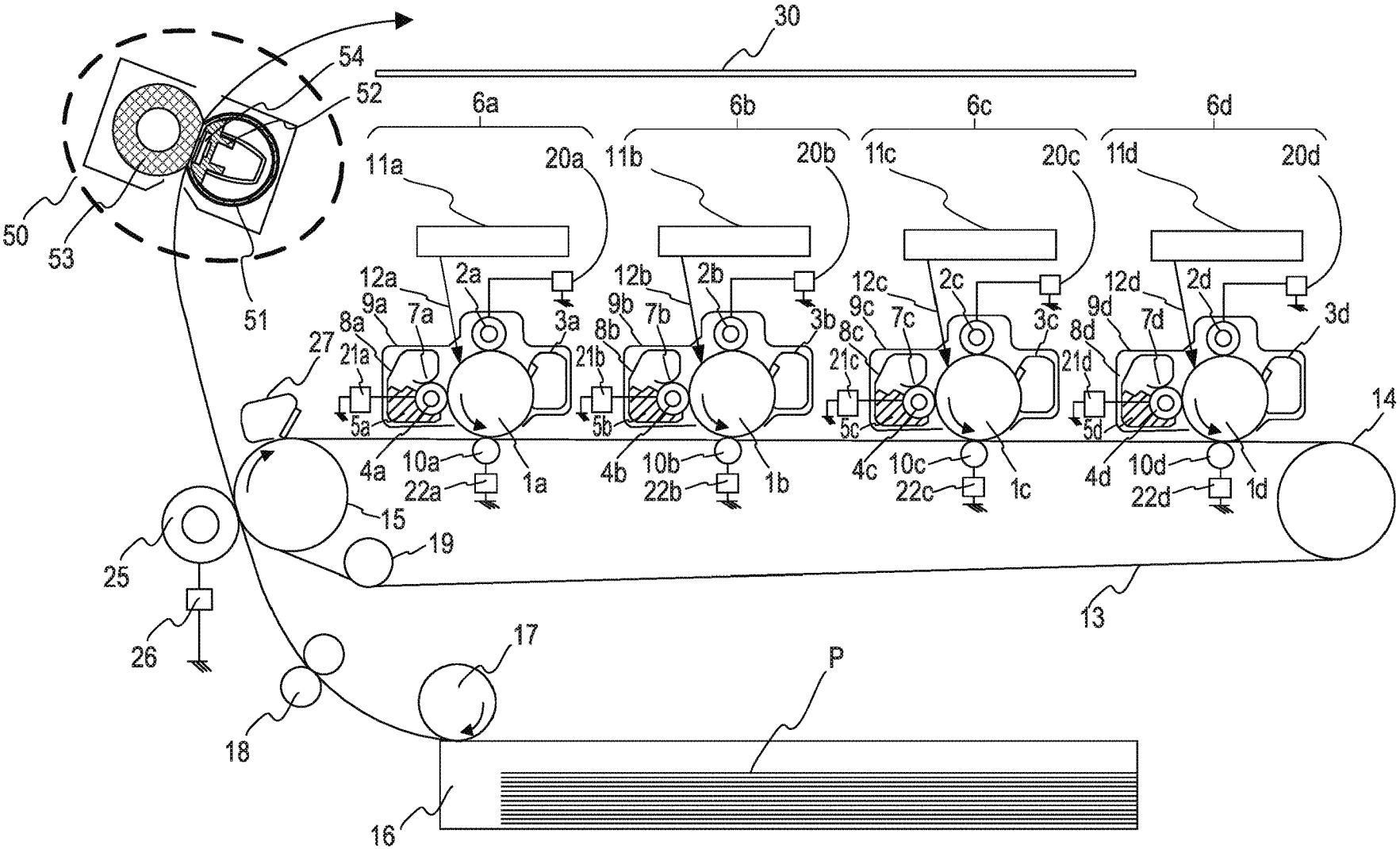
FIG. 1 is a general configuration diagram of an image forming apparatus of Embodiments 1 to 3.

FIG. 1 is a configuration diagram illustrating an in-line system color image forming apparatus, which is an example of an image forming apparatus carrying a fixing apparatus of Embodiment 1. The operation of an electrophotography system color image forming apparatus will be described by using FIG. 1. Further, a first station 6*a* is a station for toner image formation of a yellow (Y) color. A second station 6*b* is a station for toner image formation of a magenta (M) color. A third station 6*c* is a station for toner image formation of a cyan (C) color. A fourth station 6*d* is a station for toner image formation of a black (K) color.

In the first station 6*a*, a photosensitive drum 1*a*, which is an image carrier, is an OPC photosensitive drum. The photosensitive drum 1*a* is formed by stacking, on a metal cylinder, a plurality of layers of functional organic materials including a carrier generation layer exposed and generates an electric charge, a charge transport layer transporting the generated electric charge, etc., and the outermost layer has a low electric conductivity and is almost insulated. A charge roller 2*a*, which is a charging unit, contacts the photosensitive drum 1*a*, and uniformly charges a surface of the photosensitive drum 1*a* while performing following rotation with the rotation of the photosensitive drums 1*a*. The voltage superimposed with one of a DC voltage and an AC voltage is applied to the charge roller 2*a*, and when an electric discharge occurs in minute air gaps on the upstream side and the downstream side of a rotation direction from a nip portion between the charge roller 2*a* and the surface of the photosensitive drum 1*a*, the photosensitive drum 1*a* is charged. A cleaning unit 3*a* is a unit that cleans a toner remaining on the photosensitive drum 1*a* after the transfer, which will be described later. A development unit 8*a*, which is a developing unit, includes a developing roller 4*a*, a nonmagnetic monocomponent toner 5*a*, and a developer application blade 7*a*. The photosensitive drum 1*a*, the charge roller 2*a*, the cleaning unit 3*a*, and the development unit 8*a* form an integral-type process cartridge 9*a* that can be freely attached to and detached from the image forming apparatus.

An exposure device 11*a*, which is an exposing unit, includes one of a scanner unit scanning a laser beam with a polygon mirror, and an LED (light emitting diode) array, and irradiates a scanning beam 12*a* modulated based on an image signal on the photosensitive drum 1*a*. Additionally, the charge roller 2*a* is connected to a high voltage power supply for charge 20*a*, which is a voltage supplying unit to the charge roller 2*a*. The developing roller 4*a* is connected to a high voltage power supply for development 21*a*, which is a voltage supplying unit to the developing roller 4*a*. A primary transfer roller 10*a* is connected to a high voltage power supply for primary transfer 22*a*, which is a voltage supplying unit to the primary transfer roller 10*a*. The first station 6*a* is configured as described above, and the second station 6*b*, the third station 6*c*, and the fourth station are also configured in the same manner. For the other stations, the identical numerals are assigned to the components having the identical functions as those of the first station 6*a*, and *b*, *c* and *d* are assigned as the subscripts of the numerals for the respective stations. In the following description, subscripts a, b, c and d are omitted except for the case where a specific station is described.

An intermediate transfer belt 13 is supported by three rollers, i.e., a secondary transfer opposing roller 15, a tension roller 14, and an auxiliary roller 19, as its tensioning members. The force in the direction of tensioning the intermediate transfer belt 13 is applied only to the tension roller 14 by a spring (not illustrated), and a suitable tension force for the intermediate transfer belt 13 is maintained. The secondary transfer opposing roller 15 is rotated in response to the rotation drive from a main motor (not illustrated), and the intermediate transfer belt 13 wound around the outer circumference is rotated. The intermediate transfer belt 13 is moved at substantially the same speed in a forward direction (for example, the clockwise direction in FIG. 1) with respect to the photosensitive drums 1*a* to 1*d* (for example, rotated in the counterclockwise direction in FIG. 1). Additionally, the intermediate transfer belt 13 is rotated in an arrow direction (the clockwise direction), and the primary transfer roller 10 is arranged on the opposite side of the photosensitive drum 1 across the intermediate transfer belt 13, and performs the following rotation with the movement of the intermediate transfer belt 13. The position at which the photosensitive drum 1 and the primary transfer roller 10 contact each other across the intermediate transfer belt 13 is referred to as a primary transfer position. The auxiliary roller 19, the tension roller 14, and the secondary transfer opposing roller 15 are electrically grounded. Note that, also in the second station 6*b* to the fourth station 6*d*, since primary transfer rollers 10*b* to 10*d* are configured in the same manner as the primary transfer roller 10*a* of the first station 6*a*, a description will be omitted.

Next, the image forming operation of the image forming apparatus of Embodiment 1 will be described. The image forming apparatus starts the image forming operation, when a print command is received in a standby state. The photosensitive drums 1*a* to 1*d*, the intermediate transfer belt 13, etc. start rotation in the arrow direction at a predetermined process speed by the main motor (not illustrated). The photosensitive drum 1*a* is uniformly charged by the charge roller 2*a* to which the voltage is applied by the high voltage power supply for charge 20*a*, and subsequently, an electrostatic latent image according to image information is formed by the scanning beam 12*a* irradiated from the exposure device 11*a*. A toner 5*a* in the development unit 8*a* is charged in negative polarity by the developer application blade 7*a*, and is applied to the developing roller 4*a*. Then, a predetermined developing voltage is supplied to the developing roller 4*a* by the high voltage power supply for development 21*a*. When the photosensitive drum 1*a* is rotated, and the electrostatic latent image formed on the photosensitive drum 1*a* reaches the developing roller 4*a*, the electrostatic latent image is visualized when the toner of negative polarity adheres, and a toner image of a first amorous glance (for example, Y (yellow)) is formed on the photosensitive drum 1*a*. The respective stations (process cartridges 9*b* to 9*d*) of the other colors M (magenta), C (cyan), and K (black) are also similarly operated. An electrostatic latent image is formed on each of the photosensitive drums 1*a* to 1*d* by exposure, while delaying a writing signal from a controller (not illustrated) with a fixed timing, according to the distance between the primary transfer positions of the respective colors. A DC high voltage having the reverse polarity to that of the toner is applied to each of the primary transfer rollers 10*a* to 10*d*. With the above-described processes, toner images are sequentially transferred to the intermediate transfer belt 13 (hereinafter referred to as the primary transfer), and a multi toner image is formed on the intermediate transfer belt 13.

Thereafter, according to imaging of the toner image, a sheet P that is a recording material loaded in a cassette 16 is fed (picked up) by a feeding roller 17 rotated and driven by a feeding solenoid (not illustrated). The fed sheet P is conveyed to a registration roller 18 by a conveyance roller. The sheet P is conveyed by the registration roller 18 to a transfer nip portion, which is a contact portion between the intermediate transfer belt 13 and a secondary transfer roller 25, in synchronization with the toner image on the intermediate transfer belt 13. The voltage having the reverse polarity to that of the toner is applied to the secondary transfer roller 25 by a high voltage power supply for secondary transfer 26, and the four-color multi toner image carried on the intermediate transfer belt 13 is collectively transferred onto the sheet P (onto the recording material) (hereinafter referred to as the secondary transfer). The members (for example, the photosensitive drum 1) that have contributed to the formation of the unfixed toner image on the sheet P function as an image forming unit. On the other hand, after completing the secondary transfer, the toner remaining on the intermediate transfer belt 13 is cleaned by a cleaning unit 27. The sheet P to which the secondary transfer is completed is conveyed to a fixing apparatus 50, which is a fixing unit, and is discharged to a discharge tray 30 as an image formed matter (a print, a copy) in response to fixing of the toner image. A film 51 of the fixing apparatus 50, a nip forming member 52, a pressure roller 53, and a heater 54 will be described later.

[Block Diagram of Image Forming Apparatus]

Figure 2:
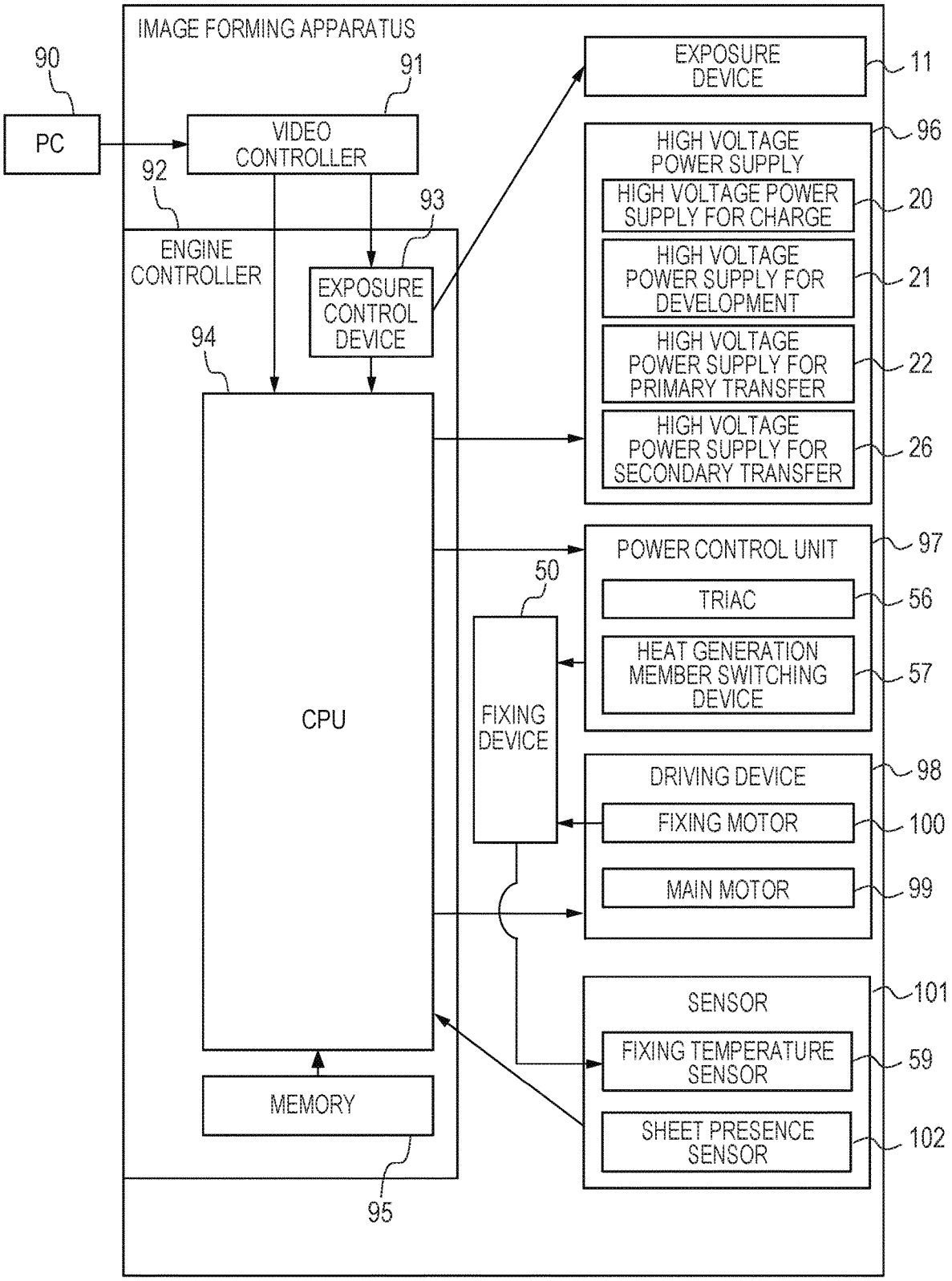
FIG. 2 is a control block diagram of the image forming apparatus of Embodiments 1 to 3.

FIG. 2 is a block diagram for describing the operation of the image forming apparatus, and referring to this diagram, the print operation of the image forming apparatus will be described. A PC 90, which is a host computer, outputs a print command to a video controller 91 inside the image forming apparatus, and plays the role of transferring image data of a printing image to the video controller 91.

The video controller 91 converts the image data from the PC 90 into exposure data, and transfers the exposure data to an exposure control device 93 inside an engine controller 92.

The exposure control device 93 is controlled from a CPU 94, and performs control of the exposure device 11 that performs turning on and off of laser light according to the exposure data. The CPU 94, which is a control unit, starts an image forming sequence, when a print command is received.

The CPU 94, a memory 95, etc. are mounted in the engine controller 92, and the operation programmed in advance is performed. The high voltage power supply 96 includes the above-described high voltage power supply for charge 20, high voltage power supply for development 21, high voltage power supply for primary transfer 22, and high voltage power supply for secondary transfer 26. Additionally, a power control unit 97 includes a bidirectional thyristor (hereinafter referred to as the triac) 56, a heat generation member switching device 57 as a first switching unit that exclusively selects the heat generation members supplying electric power, etc. The heat generation member switching device 57 switches connection between one of a heat generation member 54*b*1 and a heat generation member 54*b*2 described later, and an AC power supply 55 described later. The power control unit 97 selects the heat generation member that generates heat in the fixing apparatus 50 illustrated in FIG. 1 and FIG. 2, and determines the electric energy to be supplied. Additionally, a driving device 98 includes a main motor 99, a fixing motor 100 that rotates and drives the fixing apparatus 50 described later, etc. In addition, a sensor 101 includes a fixing temperature sensor 59 that detects the temperature of the fixing apparatus 50, and a sheet presence sensor 102 that has a flag and detects the existence of the sheet P, and the detection result of the sensor 101 is transmitted to the CPU 94. The CPU 94 obtains the detection result of the sensor 101 in the image forming apparatus, and controls the exposure device 11, the high voltage power supply 96, the power control unit 97, and the driving device 98. Accordingly, the CPU 94 performs the formation of an electrostatic latent image, the transfer of a developed toner image, the fixing of a toner image to the sheet P, etc., and controls an image formation process in which the exposure data is printed on the sheet P as the toner image. Note that the image forming apparatus to which the present invention is applied is not limited to the image forming apparatus having the configuration described in FIG. 1, and may be an image forming apparatus that can print sheets P having different widths, and that includes the fixing apparatus 50 including the heater 54, which will be described later.

[Configuration of Fixing Apparatus]

Figure 3:
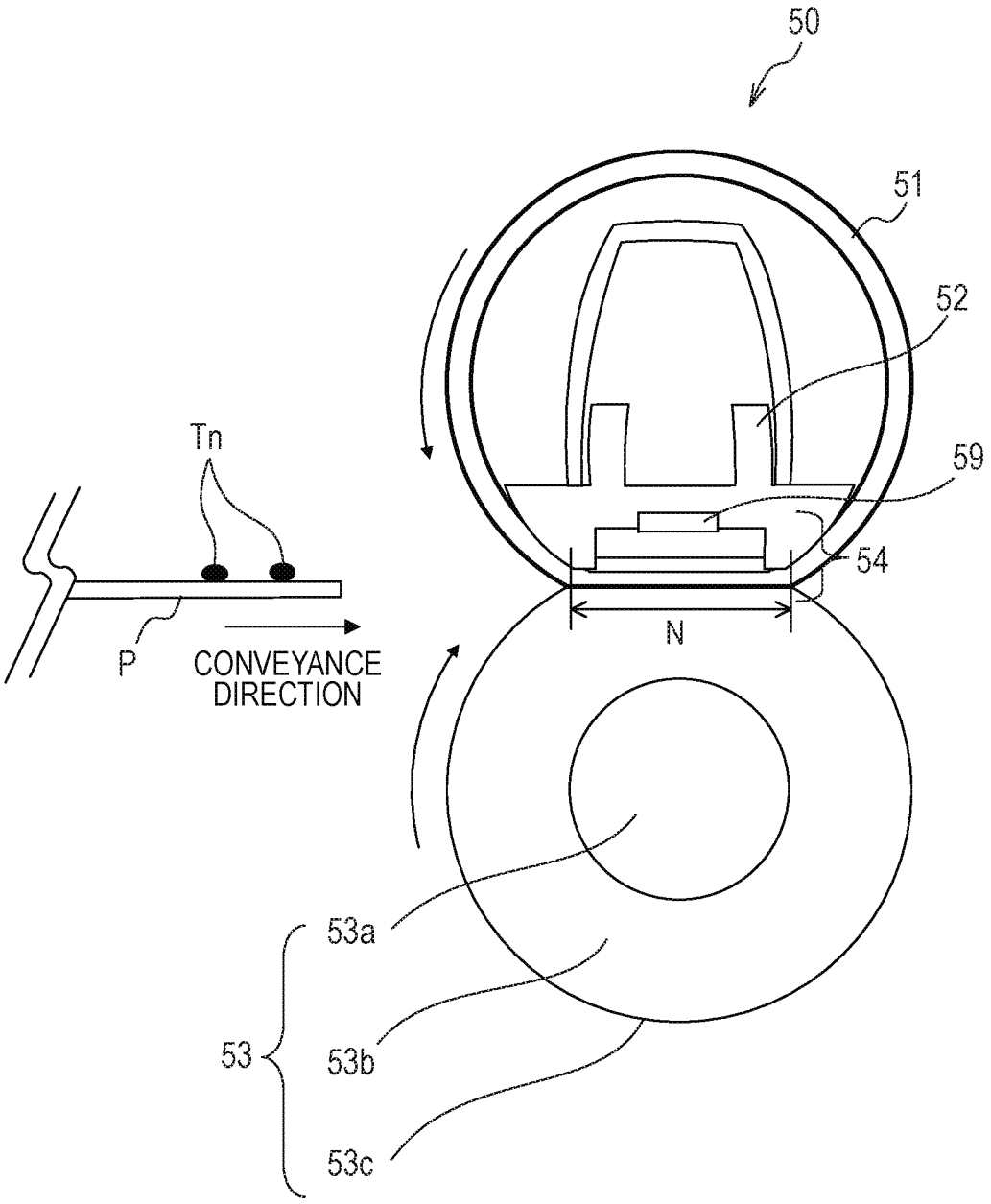
FIG. 3 is a cross-sectional schematic diagram near a center portion in a longitudinal direction of the fixing apparatus of Embodiments 1 to 3.

Next, the configuration of the fixing apparatus 50 in Embodiment 1, which controls the fixing apparatus 50 that heats the toner image on the sheet P with the heat generation members, will be described by using FIG. 3. Here, a longitudinal direction is the rotation axis direction of the pressure roller 53 substantially perpendicular to the conveyance direction of the sheet P described later. Additionally, the length of the sheet P in the direction (the longitudinal direction) substantially perpendicular to the conveyance direction is referred to as the width. FIG. 3 is a cross-sectional schematic diagram of the fixing apparatus 50. The sheet P holding an unfixed toner image Tn is heated while being conveyed from the left side in FIG. 3 toward the right in a fixation nip portion N, and thus the toner image Tn is fixed to the sheet P. The fixing apparatus 50 in Embodiment 1 includes a cylindrical film 51, the nip forming member 52 holding the film 51, the pressure roller 53 forming the fixation nip portion N with the film 51, the heater 54 that is a heater unit for heating the sheet P. The fixing apparatus 50 also includes the fixing temperature sensor 59.

The film 51, which is a first rotary member, is a fixing film as a heating rotary member. In Embodiment 1, for example, polyimide is used as a base layer. An elastic layer made of silicone rubber, and a release layer made of PFA are used on the base layer. In order to reduce the frictional force generated between the nip forming member 52 and the heater 54 and the film 51 by rotation of the film 51, grease is applied to the inner surface of the film 51.

The nip forming member 52 plays the role of guiding the film 51 from the inner side, and forming the fixation nip portion N between the nip forming member 52 and the pressure rollers 53 through the film 51. The nip forming member 52 is a member having rigidity, heat resistance, and thermal insulation properties, and is formed by a liquid crystal polymer, etc. The film 51 is fit onto this nip forming member 52. The pressure roller 53, which is a second rotary member, is a roller as a pressing rotary member. The pressure roller 53 includes a cored bar 53*a*, an elastic layer 53*b*, and a release layer 53*c*. The pressure roller 53 is rotatably maintained at both ends, and is rotated and driven by the fixing motor 100 (see FIG. 2). Additionally, the film 51 performs the following rotation by the rotation of the pressure roller 53. The heater 54, which is a heating member, is held by the nip forming member 52, and contacts the inner surface of the film 51. The heater 54 and the fixing temperature sensor 59 will be described later.

[Circuit Configuration of Fixing Apparatus]

Figure 4A:
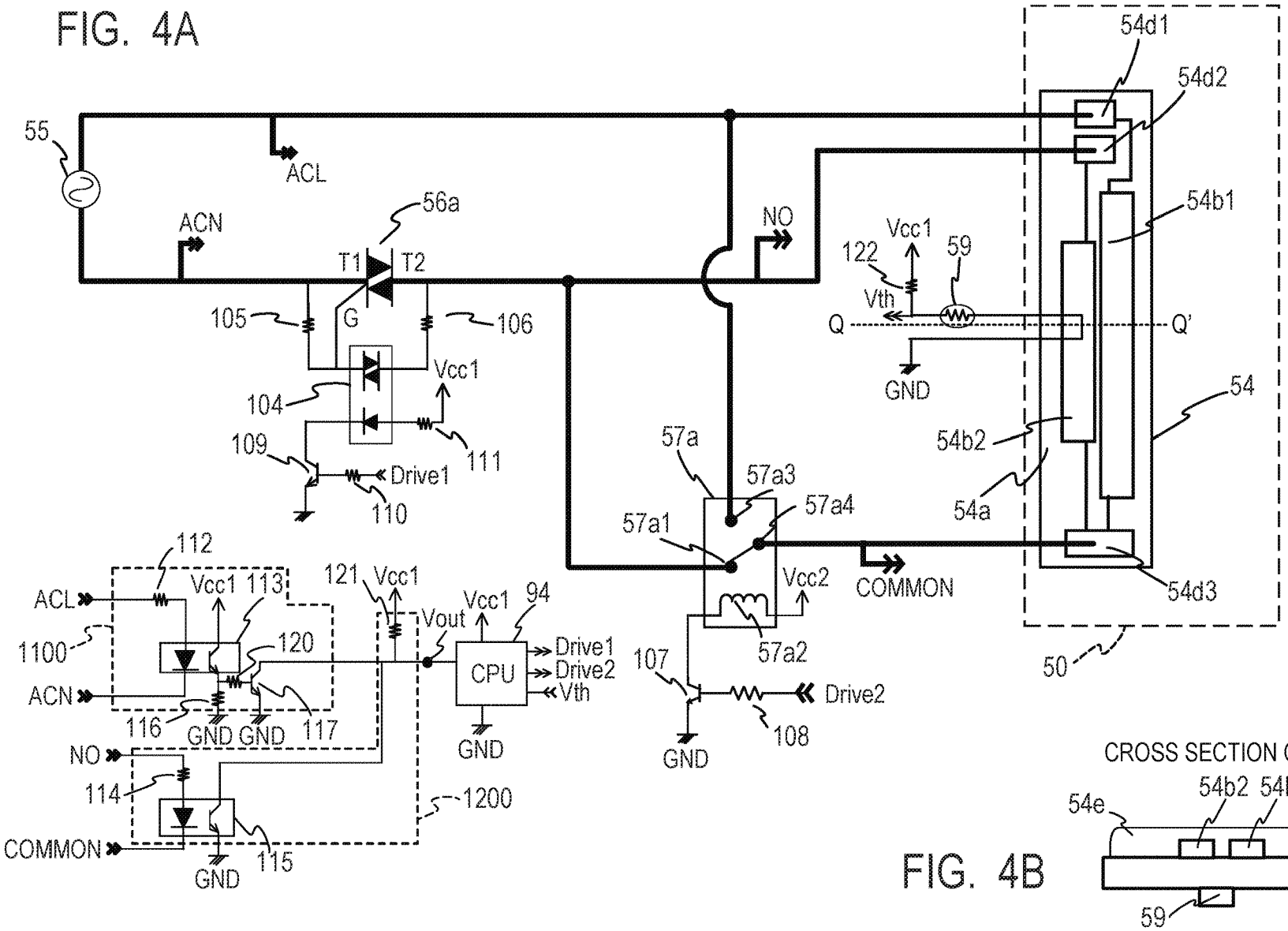
FIG. 4A is a general schematic diagram illustrating the circuit configuration of the fixing apparatus of Embodiment 1.

FIG. 4A is a diagram illustrating the general schematic diagram of the fixing apparatus 50 of Embodiment 1. FIG. 4A is a general schematic diagram illustrating the circuit configuration of the fixing apparatus 50. The heater 54, which is a heating unit in the fixing apparatus 50, receives the power supply from the AC power supply 55, and generates heat. The heater 54, which is a heater unit, mainly includes heat generation members 54*b*1 and 54*b*2 formed on a substrate 54*a*, contacts 54*d*1, 54*d*2 and 54*d*3 to which ends of the heat generation members 54*b*1 and 54*b*2 are connected, and a cover glass layer 54*e*. The heater 54 includes at least two or more, i.e., a plurality of heat generation members. For example, the heater 54 includes the heat generation member 54*b*1 and the heat generation member 54*b*2. The heat generation member 54*b*1 and 54*b*2 are resistors that generate heat by the power supply from the AC power supply 55. The length of the heat generation member 54*b*1, which is a first heat generation member, in the longitudinal direction is set to be longer than the sheet width (182 mm) of the B5 size by about several millimeters. Additionally, the heat generation member 54*b*2, which is a second heat generation member, is a heater aiming at mainly heating a sheet P having a width narrower than the heat generation member 54*b*1, and the length of the heat generation member 54*b*2 in the longitudinal direction is set to be longer than the sheet width (148 mm) of the A5 size by about several millimeters. The fixing apparatus 50 switches the heat generation member to be used to the heat generation member 54*b*1 or the heat generation member 54*b*2, according to the paper width of the sheet P to be used. Further, it is assumed that a first resistance value of the heat generation member 54*b*1 is set to be smaller than a second resistance value of the heat generation member 54*b*2.

Figure 4B:
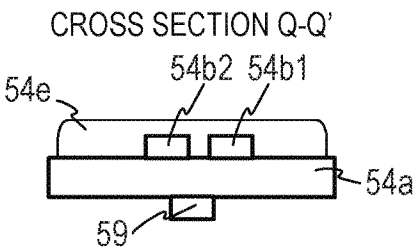
FIG. 4B is a cross-sectional view of a heater of the fixing apparatus of Embodiment 1.

FIG. 4B is a cross-sectional view illustrating the cross section obtained by cutting the heater 54 of the fixing apparatus 50 with a Q-Q' line illustrated in FIG. 4A. The cover glass layer 54*e* is provided in order to insulate the heat generation members 54*b*1 and 54*b*2 having substantially the same electric potential as the AC power supply 55 from a user. The fixing temperature sensor 59, which is a temperature detection unit, is installed on a surface opposite to the surface of the substrate 54*a* on which the heat generation members 54*b*1 and 54*b*2 are installed, in the range through which the sheet P having the minimum sheet width for which paper feeding can be performed passes. Note that a thermistor is used for the fixing temperature sensor 59 in Embodiment 1. As illustrated in FIG. 4B, the fixing temperature sensor 59 contacts and is installed in the substrate 54*a*, and detects the temperatures of the heat generation members 54*b*1 and 54*b*2 through the substrate 54*a*. One end of the fixing temperature sensor 59 is connected to a resistance 122, and the other end is connected to GND (ground). Then, a voltage Vth, which is obtained by dividing a DC voltage Vcc1 by the fixing temperature sensor 59 and the resistance 122, is input to the CPU 94.

The contact 54*d*3 to which one ends of the heat generation members 54*b*1 and 54*b*2 are connected, the contact 54*d*2 to which the other end of the heat generation member 54*b*2 is connected, and the contact 54*d*1 to which the other end of the heat generation member 54*b*1 is connected are connected to a circuit that controls the fixing apparatus 50 illustrated in FIG. 4A. The contact 54*d*3 is connected to a contact 57*a*4 of a relay 57*a* having a c-contact structure, and the contact 54*d*1 is connected to a contact 57*a*3. The relay 57*a*, which is the heat generation member switching device 57, is a relay having the c-contact structure, and includes a coil part 57*a*2, and contacts 57*a*1, 57*a*3 and 57*a*4. One terminal of the coil part 57*a*2 is connected to a 24V DC voltage Vcc2, and another terminal is connected to a collector terminal of a transistor 107. In a case where the CPU 94 outputs a Drive 2 signal at a high (High) level, a base current flows into a base terminal of the transistor 107 through a resistance 108. Accordingly, the voltage between the collector terminal and the emitter terminal of the transistor 107 becomes a saturation voltage of about 0.2 V to 0.3 V, and the transistor 107 is turned on. When the transistor 107 is turned on, since a collector current flows, an electric potential difference is generated between both ends of the coil part 57*a*2, a current flows into the coil part 57*a*2, and the contact 57*a*4 is connected to the contact 57*a*3 by a magnetic force generated in the coil part 57*a*2. Hereinafter, this state is referred to as the turn-on state of the relay 57*a*.

On the other hand, in a case where the CPU 94 outputs a Drive 2 signal at a low (Low) level, the base current does not flow into the base terminal of the transistor 107. Therefore, the transistor 107 is not turned on, and an electric potential difference is not generated between both ends of the coil part 57*a*2. As a result, since a current does not flow into the coil part 57*a*2 and a magnetic force is not generated, the contact 57*a*4 is connected to the contact 57*a*1. Hereinafter, this state is referred to as the turn-off state of the relay 57*a*. That is, with the operation of the relay 57*a* having the c-contact structure, in the turn-on state of the relay 57*a*, the contact 57*a*4 is connected to the contact 57*a*3, and power supply is performed to the heat generation member 54*b*2 through the contact 54*d*3 and the contact 54*d*2 from the AC power supply 55. On the other hand, in the turn-off state of the relay 57*a*, the contact 57*a*4 is connected to the contact 57*a*1, and power supply is performed to the heat generation member 54*b*1 through the contact 54*d*3 and the contact 54*d*1 from the AC power supply 55.

The CPU 94 controls a triac 56*a*, which is a second switching unit, so that the fixing temperature sensor 59 becomes a target temperature defined in advance, based on the input temperature information of the voltage Vth of the fixing temperature sensor 59. Specifically, when the CPU 94 outputs a high-level Drive 1 signal, a base current flows into the base terminal of the transistor 109 through a base resistance 110, and accordingly, the transistor 109 is turned on, and a collector current flows. When the collector current of the transistor 109 flows, a light emitting diode of a phototriac coupler 104 is in a conduction state, a current flows through a resistance 111 and the light emitting diode emits light, and a light receiving portion of the phototriac coupler 104 is in the conduction state. When the light-receiving side of the phototriac coupler 104 is in the conduction state, a gate trigger current flows between a T1 terminal and a G terminal of the triac 56*a* through a current limiting resistor 105. Accordingly, between the T1 terminal and a T2 terminal of the triac 56*a* is in the conduction state (hereinafter referred to as the turn-on state of the triac 56*a*). Note that a resistance 106 is also a current limiting resistor.

On the other hand, when the CPU 94 outputs a low-level Drive 1 signal, the base current does not flow into the base terminal of the transistor 109, and the transistor 109 is not turned on. As a result, the light emitting diode of the phototriac coupler 104 does not emit light, and the light receiving portion of the phototriac coupler 104 is in a non-conduction state. Then, the gate trigger current of the triac 56*a* does not flow, and between the T1 terminal and the T2 terminal of the triac 56*a* is in the non-conduction state (hereinafter referred to as the turn-off state of the triac 56*a*). Based on paper width information of the sheet P, the CPU 94 controls the relay 57*a* to switch the heat generation member to which electric power is supplied. Then, the CPU 94 controls the triac 56*a* based on the temperature information detected by the fixing temperature sensor 59, performs power supply from the AC power supply 55 to the heater 54, and performs temperature control of the fixing apparatus 50.

[Configuration and Operation of Zero-Crossing Circuit Unit]

The circuit configuration for detecting a zero-crossing signal of the AC power supply 55 will be described. In Embodiment 1, a zero-crossing circuit unit 1100 that detects the zero-crossing signal of the AC power supply 55 includes a resistance 112, a resistance 116, a resistance 120, a photocoupler 113, and a transistor 117. One end of the resistance 112 is connected to a first pole (ACL portion) of the AC power supply 55, and the other end is connected to the anode of an LED of the photocoupler 113. The cathode of the LED of the photocoupler 113, which is a first photocoupler, is connected to a second pole (ACN portion) of the AC power supply 55. A collector of a light-receiving side transistor of the photocoupler 113 is connected to a 3.3 V DC voltage Vcc1. The emitter of the light-receiving side transistor of the photocoupler 113 is connected to one ends of the resistance 116 and the resistance 120. The other end of the resistance 116 is connected to the GND. The other end of the resistance 120 is connected to a base of the transistor 117. The emitter of the transistor 117 is connected to the GND, and a collector is connected to one end of a resistance 121 and the CPU 94 (hereinafter referred to as the Vout section).

Irrespective of whether the triac 56*a* is in the turn-on state or the turn-off state, when a voltage equal to or more than a constant value is supplied from the AC power supply 55 to the photocoupler 113, a current is supplied from the ACL portion through the resistance 112, and the LED emits light. When the LED of the photocoupler 113 emits light, a light reception current flows into the base of the light-receiving side transistor, the transistor of the photocoupler 113 is turned on, and a current flows into the collector. Hereinafter, this state is referred to as the turn-on state of the photocoupler 113. When the photocoupler 113 is turned on, a current flows into the resistance 116 through the DC voltage Vcc1, and an electric potential difference is generated between both ends of the resistance 116. With the voltage generated across both ends of the resistance 116, a current flows into the base of the transistor 117 through the resistance 120. Accordingly, the transistor 117 is turned on, and a collector current flows. When the collector current of the transistor 117 flows, a current flows through the DC voltage Vcc1 and the resistance 121. Accordingly, the voltage of the Vout portion, which is an input terminal of the CPU 94, falls from 3.3 V, which is the voltage of Vcc1, to about 0.3 V, which is the collector to emitter voltage of the transistor 117.

When the voltage of the AC power supply 55 falls to a constant value or less, the current does not flow into the LED of the photocoupler 113, and the current does not flow into the base of the transistor 117. Since the current does not flow into the base of the transistor 117, the transistor 117 is in the turn-off state, and the current does not flow into the resistance 121. Accordingly, the potential at the Vout portion rises from about 0.3 V, which is the collector to emitter voltage of the transistor 117, to 3.3 V, which is the same electric potential as the DC voltage Vcc1. Hereinafter, this state is referred to as the turn-off state of the photocoupler 113. The CPU 94 outputs the high-level Drive 1 signal after a defined period of time elapses since a reference, the reference being the timing at which the potential at the Vout portion rises from near 0.3 V to the same electric potential as the DC voltage Vcc1 (hereinafter referred to as the zero-crossing signal). Accordingly, the triac 56*a* is set in one of the turn-on state and the turn-off state. Accordingly, power supply from the AC power supply 55 to the heater 54 and cutoff are repeated. The CPU 94 controls the triac 56*a* based on the temperature information detected by the fixing temperature sensor 59 by repeating power supply to the heater 54 and cutoff, thereby performing temperature control of the fixing apparatus 50.

[Determination Circuit Configuration for Power Supply to Heat Generation Members]

The configuration of a determination circuit unit 1200 that determines power supply to the heat generation member 54*b* of Embodiment 1 will be described by using FIG. 4A. In Embodiment 1, the determination circuit unit 1200 includes a resistance 114, a photocoupler 115, and the resistance 121. The cathode of an LED of the photocoupler 115, which is a second photocoupler, is connected between the contact 57*a*4 of the relay 57*a* and the contact 54*d*3 of the heater 54 (hereinafter referred to as a COMMON portion), and the anode is connected to one end of the resistance 114. The other end of the resistance 114 is connected between the contact 54*d*2 of the heater 54, and the contact 57*a*1 of the relay 57*a* and the triac 56*a* (hereinafter referred to as a NO portion). The COMMON portion is between the relay 57*a* and one end of one of the heat generation member 54*b*1 and the heat generation member 54*b*2. The NO portion is between the triac 56*a* and the other end of the heat generation member 54*b*2.

The emitter of a light-receiving side transistor of the photocoupler 115 is connected to the GND. A collector is connected to one end of the resistance 121, and the Vout portion, which is the input terminal of the CPU 94. The other end of the resistance 121 is connected to the DC voltage Vcc1, which is +3.3 V. The resistance 114, which is a second resistance, has a large resistance value with respect to the resistance 112, which is a first resistance, and a detailed value will be described later. The photocoupler 113 of the zero-crossing circuit unit 1100 and the photocoupler 115 of the determination circuit unit 1200 are pulled up to the DC voltage Vcc1 through the resistance 121. It is formed as an OR circuit in which the voltage of the Vout portion falls, when one of the zero-crossing circuit unit 1100 and the determination circuit units 1200 is in the turn-on state.

[Operation of Determination Circuit Unit]

Figure 5A:
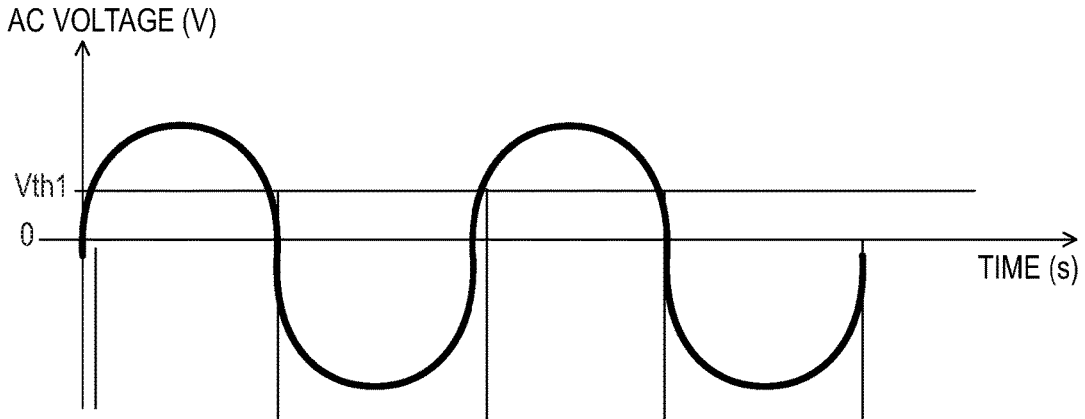
FIG. 5A, FIG. 5B and FIG. 5C are output voltage wave form charts of an AC voltage, a Vout portion, and a CPU internal logic of Embodiment 1, respectively.
Figure 5B:
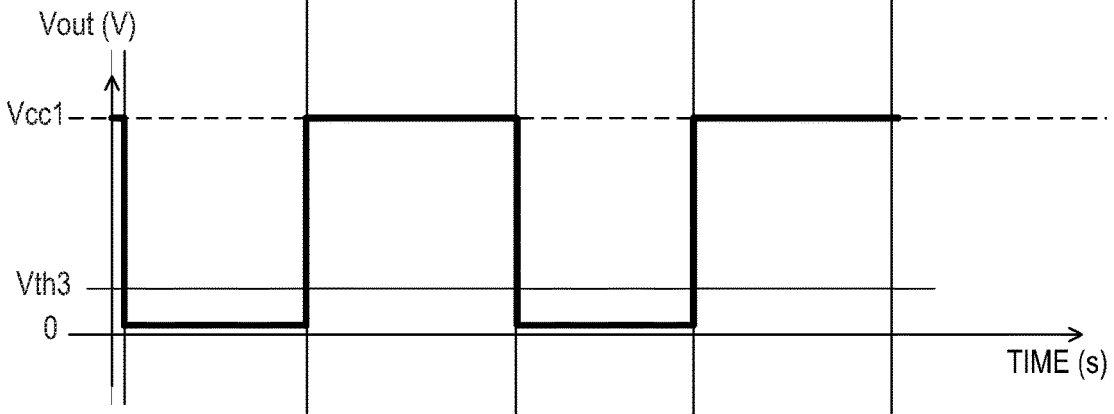
Figure 5C:
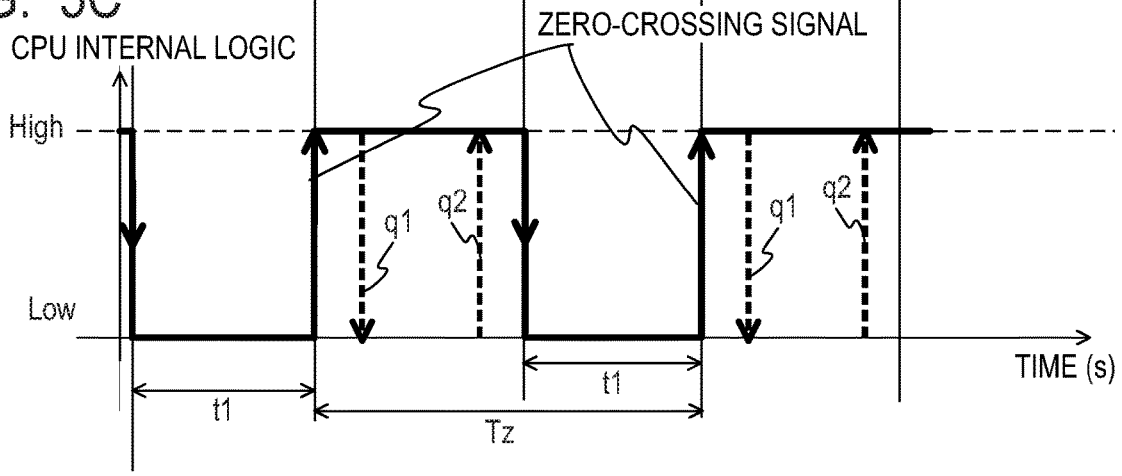
Figure 6A:
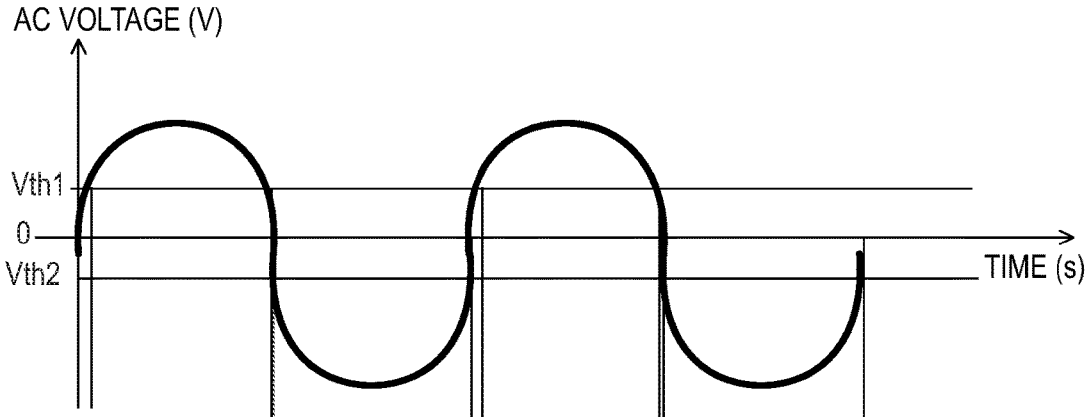
FIG. 6A, FIG. 6B and FIG. 6C are output voltage wave form charts of the AC voltage, the Vout portion, and the CPU internal logic of Embodiment 1, respectively.
Figure 6B:
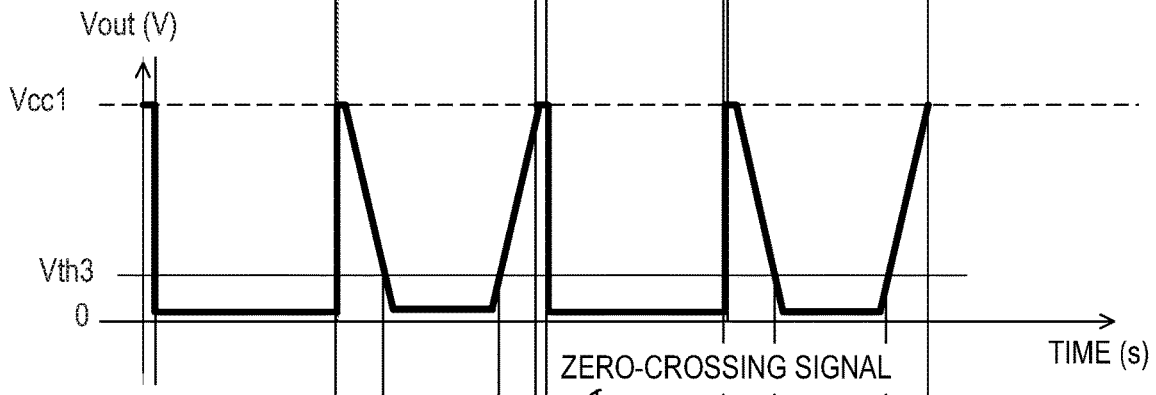
Figure 6C:
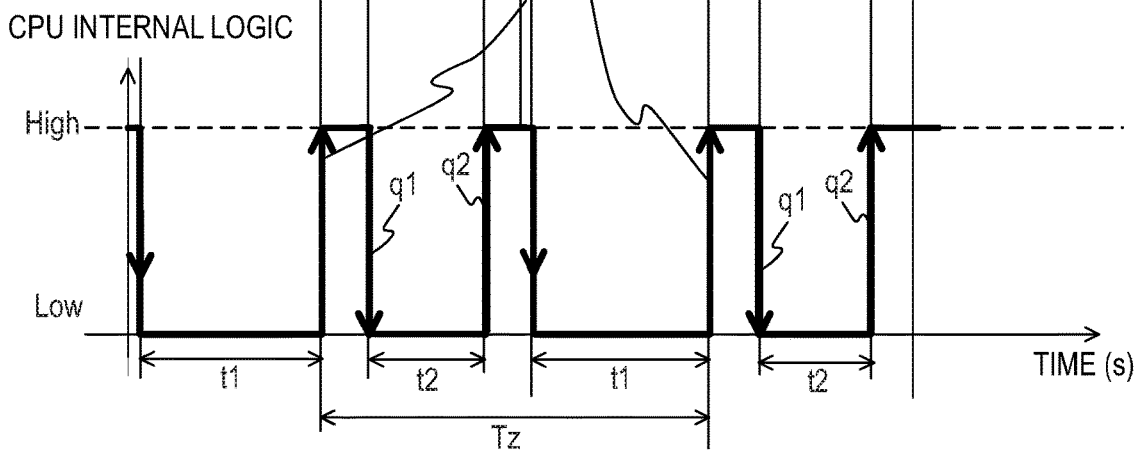

The operations of the zero-crossing circuit unit 1100 and the determination circuit unit 1200 will be described. FIG. 5A and FIG. 6A illustrate the waveforms of the AC power supply 55, Vth1, which is a light emission voltage with which the photocoupler 113 is in the turn-on state, is indicated with a thin line, and Vth2, which is a light emission voltage with which the photocoupler 115 is in the turn-on state, is indicated with a thin line in FIG. 6A to FIG. 6C. FIG. 5B and FIG. 6B illustrate the waveforms of the potential at the Vout portion, and indicate Vcc1 at which the potential at the Vout portion becomes the highest with a broken line. Additionally, a threshold value Vth3 of an internal logic of the CPU 94 is indicated with a thin line in FIG. 5B and FIG. 6B. Further, it is assumed that the CPU 94 is at a high level (High) in a case where the voltage of the Vout portion is higher than the threshold value Vth3, and the CPU 94 is at a low level (Low) in a case where the potential of the Vout portion is equal to or less than the threshold value Vth3. FIG. 5C and FIG. 6C illustrate the output voltage states of the internal logic of the CPU 94 of the Vout portion, and indicate the high level (High) and the low level (Low) of the logic. In any of the figures, a horizontal axis represents the time (second (s)).

FIG. 5A to FIG. 5C are output waveform diagrams of the relay 57*a* in the turn-off state (the state where the contacts 57*a*1 and 57*a*4 are conducted) (that is, the state where electric power is supplied to the heat generation member 54*b*1). FIG. 6A to FIG. 6C are output waveform diagrams of the relay 57*a* in the turn-on state (the state where the contacts 57*a*3 and 57*a*4 are conducted) (that is, the state where electric power is supplied to the heat generation member 54*b*2).

(When Relay is in OFF State (Heat Generation Member 54*b*1 is Connected))

(ACL Portion>ACN Portion)

First, the operation in a case where the relay 57*a* is turned off (in the state where the contacts 57*a*1 and 57*a*4 are conducted), and electric power is supplied to the heat generation member 54*b*1 will be described by using FIG. 5A to FIG. 5C. When the triac 56*a* is in the turn-on state with the Drive 1 signal of the CPU 94, electric power is supplied to the heater 54 from the AC power supply 55. When electric power is supplied to the heater 54 from the AC power supply 55, the voltage of the ACL portion becomes high with respect to the ACN portion, and in a case where a current flows into the ACN portion through the heater 54 from the ACL portion, the following occurs. That is, when the voltage of the ACL portion exceeds Vth1, which is the LED light emission voltage of the photocoupler 113 with respect to the ACN portion, a current flows into the LED of the photocoupler 113 through the resistance 112, and the photocoupler 113 is in the turn-on state.

On the other hand, since the relay 57*a* is in the turn-off state (the state where the contacts 57*a*1 and 57*a*4 are conducted), the photocoupler 115 is short-circuited between the NO portion and the COMMON portion. Accordingly, since the potential difference between the anode and the cathode of the LED of the photocoupler 115 is eliminated, the LED does not emit light, and the photocoupler 115 is in the turn-off state. In these states, a current flows between the collector and the emitter of the transistor 117 from the DC voltage Vcc1. Then, an electric potential difference is generated between both ends of the resistance 121, and the potential at the Vout portion is decreased from the potential of the DC voltage Vcc1 to about 0.3 V, which is the collector to emitter voltage of the transistor 117. When the potential at the Vout portion is decreased from the DC voltage Vcc1 to about 0.3 V, the internal logic of the CPU 94 also transitions from the high (High) state to the low (Low) state. Here, it is assumed the time period during which the CPU 94 is in the low state is t1.

(ACL Portion<ACN Portion)

Conversely, when electric power is supplied to the heater 54 from the AC power supply 55, the voltage of the ACN portion becomes positive with respect to the ACL portion, and in a case where a current flows into the ACL portion from the ACN portion through the heater 54, the following occurs. That is, the potential on the cathode side (the ACN portion) becomes high with respect to the potential on the anode side (the ACL portion) of the LED of the photocoupler 113. Since an electric potential difference is generated in the reverse direction of the LED of the photocoupler 113 in a case where the potential on the cathode side (the ACN portion) becomes high with respect to the potential on the anode side (the ACL portion) of the LED of the photocoupler 113, the LED does not emit light. Namely, the photocoupler 113 is in the turn-off state.

On the other hand, when the relay 57*a* is in the turn-off state (the state where the contacts 57*a*1 and 57*a*4 are conducted), the photocoupler 115 is short-circuited between the NO portion and the COMMON portion. Then, since the potential difference between the anode and the cathode of the LED of the photocoupler 115 is eliminated, the LED does not emit light, and is in the turn-off state. Since both the photocoupler 113 and the photocoupler 115 are in the turn-off state, the potential at the Vout portion is pulled up by the resistance 121, and has the same electric potential as the DC voltage Vcc1. Subsequently, the same action will be repeated.

(When Relay is in ON State (Heat Generation Member 54*b*2 is Connected))

(ACL Portion>ACN Portion)

Next, the operation in a case where the relay 57*a* is in the turn-on state (the state where the contact 57*a*3 and the contact 57*a*4 are short-circuited), and electric power is supplied to the heat generation member 54*b*2 will be described by using FIG. 6A to FIG. 6C. When the triac 56*a* is set in the turn-on state by the Drive 1 signal of the CPU 94, electric power is supplied to the heater 54 from the AC power supply 55. When electric power is supplied to the heater 54 from the AC power supply 55, the voltage of the ACL portion becomes positive with respect to the ACN portion, and in a case where a current flows into the ACN portion from the ACL portion through the heater 54, the following occurs. That is, when the voltage of the ACL portion exceeds Vth1, which is the LED light emission voltage of the photocoupler 113, with respect to the ACN portion, the photocoupler 113 is in the turn-on state.

On the other hand, in the photocoupler 115, in a case where the voltage of the ACL portion becomes positive, and a current flows into the ACN portion through the heater 54, the potential on the cathode side (the COMMON portion) becomes high with respect to the potential on the anode side (the NO portion) of the LED of the photocoupler 115 (the COMMON portion>the NO portion). Since an electric potential difference is generated in the reverse direction of the LED of the photocoupler 115 in a case where the potential on the cathode side (the COMMON portion) becomes high with respect to the potential on the anode side (the NO portion) of the LED of the photocoupler 115, the LED does not emit light. In short, the photocoupler 115 is in the turn-off state. Similar to FIG. 5A to FIG. 5C, since the photocoupler 113 is in the turn-on state, and the photocoupler 115 is in the turn-off state, the potential at the Vout portion falls to 0.3 V, and the internal logic of the CPU 94 transitions from High to Low. Similar to FIG. 5A to FIG. 5C, the time period during which the internal logic of the CPU 94 is Low is t1.

(ACL Portion<ACN Portion)

Conversely, when electric power is supplied to the heater 54 from the AC power supply 55, the voltage of the ACN portion becomes high with respect to the ACL portion, and in a case where a current flows into the ACL portion from the ACN portion side through the heater 54, the following occurs. That is, the potential on the cathode side (the ACN portion) becomes high with respect to the potential on the anode side (the ACL portion) of the LED of the photocoupler 113. Since an electric potential difference is generated in the reverse direction of the LED of the photocoupler 113 in a case where the potential on the cathode side (the ACN portion) becomes high with respect to the anode side (the ACL portion) of the LED of the photocoupler 113, the LED does not emit light. Namely, the photocoupler 113 is in the turn-off state.

On the other hand, in the photocoupler 115, when the voltage of the AC power supply 55 exceeds Vth2, which is the LED light emission voltage, a current begins to flow into the LED. Since the resistance 114 is high with respect to the resistance 112, and there is no transistor 117, the collector current of the light-receiving side transistor of the photocoupler 115 will be gently increased. In the Vout portion, since the photocoupler 115 is in the turn-on state, a current is flowing between the collector and the emitter of the transistor of the photocoupler 115 from the DC voltage Vcc1. Then, an electric potential difference is generated between both ends of the resistance 121, and the potential at the Vout portion is gently decreased from the potential of the DC voltage Vcc1 to about 0.3 V, which is the voltage difference between the collector and the emitter of the transistor of the photocoupler 115 (FIG. 6B). When the potential at the Vout portion is decreased from the DC voltage Vcc1 to about 0.3 V, and becomes less than the threshold value Vth3 of the internal logic of the CPU 94, the internal logical value of the CPU 94 transitions from the high (High) state to the low (Low) state (q1). Conversely, when the voltage of the AC power supply 55 becomes equal to or less than Vth2, which is LED light emission voltage, the photocoupler 115 is in the turn-off state. During this time period, the voltage of the Vout portion is gently increased toward the DC voltage Vcc1 from about 0.3 V, and when exceeding the threshold value Vth3 of the internal logic of the CPU 94, the internal logical value of the CPU 94 transitions from the low state to the high state (q2). Here, it is assumed that the time period during which the CPU 94 is in the low (Low) state is t2. Subsequently, the same action will be repeated.

From the above, in a case where electric power is supplied to the heat generation member 54*b*1 with the relay 57*a* being in the turn-off state, as illustrated in FIG. 5C, transitions of the internal logical value of the CPU 94, such as q1 and q2 indicated by broken-line arrows, do not occur. On the other hand, in a case where electric power is supplied to the heat generation member 54*b*2 with the relay 57*a* being in the turn-on state, as illustrated in FIG. 6C, transitions of the internal logical value of the CPU 94, such as q1 and q2 indicated by continuous-line arrows, occur.

In an Embodiment 1, specifically, the resistance 114 is 680 kΩ and, the resistance 112 is 94 kΩ. When a sine wave voltage having AC100 V and 50 Hz as the maximum effective value is applied to the heat generation member 54*b* from the AC power supply 55, in the turn-on state of the relay 57*a*, t1=about 9.8 ms. The ratio between t1 and t2 is determined to be a predetermined value in advance, and in Embodiment 1, for example, t2=t1×0.7, and thus t2=about 6.86 ms.

[Determination Method and Flowchart]

Figure 7:
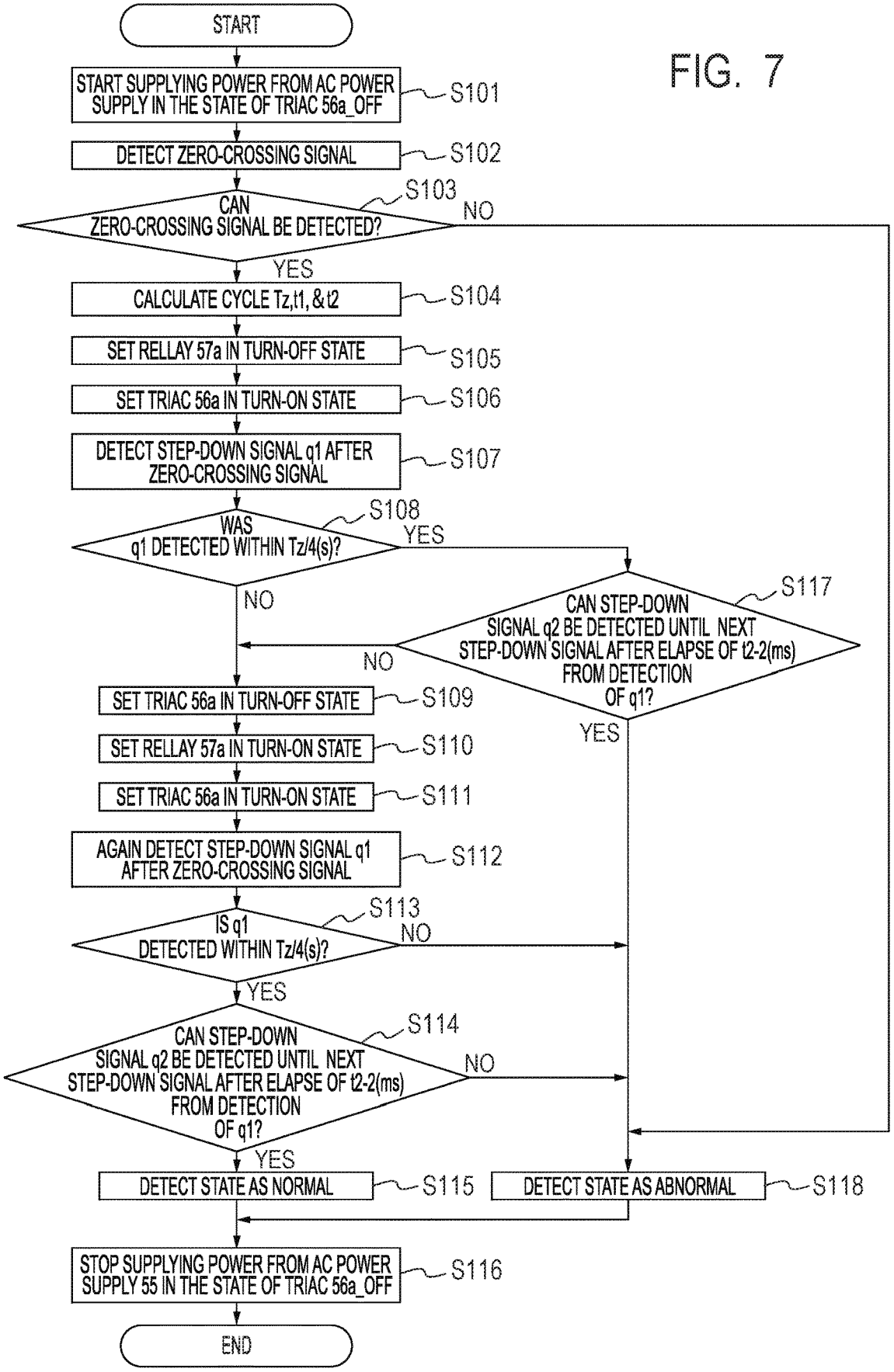
FIG. 7 is a flowchart illustrating determination processing of a heat generation member to which electric power is being supplied in Embodiment 1.

FIG. 7 is a flowchart illustrating a determination method of power supply of the heat generation member 54*b*, and the flow of determination processing. The determination processing of Embodiment 1 will be described by using FIG. 5A to FIG. 5C, FIG. 6A to FIG. 6C, and FIG. 7. At step (hereinafter referred to as S) 101, the CPU 94 sets the Drive 1 signal at the low level, sets the triac 56*a* in the turn-off state, and starts supplying electric power from the AC power supply 55 to the fixing apparatus 50 by a control circuit (not illustrated). At S102, the CPU 94 detects a zero-crossing signal. The CPU 94 detects a step-down signal with which the potential at the Vout portion of the zero-crossing circuit unit 1100 changes from the DC voltage Vcc1 to near 0.3 V. Hereinafter, the state where the potential at the Vout portion is the DC voltage Vcc1 is referred to as the High state, and the state where the potential at the Vout portion is at about 0.3 V is referred to as the Low state. The CPU 94 detects a signal that rises to the High state from the next Low state after 4.0 ms from this step-down signal as the zero-crossing signal. The detected zero-crossing signal is a first zero-crossing signal (see FIG. 5C and FIG. 6C). After detecting the first zero-crossing signal, the CPU 94 detects again the next step-up signal after 14 ms, which is a predetermined time period defined in advance, and uses the next step-up signal as a second zero-crossing signal (see FIG. 5C and FIG. 6C). The CPU 94 includes a timer (not illustrated), and measures the time period by the time at which the zero-crossing signal is detected after the internal logic transitions from the High state to the Low state, etc.

At S103, the CPU 94 determines whether or not the zero-crossing signal can be detected. At S103, in a case where it is determined that the CPU 94 cannot detect the zero-crossing signal at S102, the processing proceeds to S118. At S118, the CPU 94 determines that one of the circuit and the fixing apparatus 50 is abnormal, and the processing proceeds to S116. At S116, the CPU 94 sets the Drive 1 signal at the low level, sets the triac 56*a* in the turn-off state, cuts off power supply from the AC power supply 55 to the fixing apparatus 50 (to the turn-off state), and ends the processing.

At S103, in a case where the CPU 94 determines that the zero-crossing signal can be detected at S102, the processing proceeds to S104. At S104, the CPU 94 calculates the cycle of the AC voltage of the AC power supply 55, in other words, a cycle Tz of the zero-crossing signal, and the above-described t1 and t2. The CPU 94 derives the cycle Tz from the time difference between the first zero-crossing signal and the second zero-crossing signal (see FIG. 5C and FIG. 6C). The CPU 94 derives the time period t1 during which the internal logic of the CPU 94 is in the Low state until the next (the first) zero-crossing signal after the potential at the Vout portion changes from the High state to the Low state. The CPU 94 calculates t2 by multiplying t1 by 0.7 as described above.

At S105, the CPU 94 sets the Drive 2 signal to Low, and sets the relay 57*a* in the turn-off state. Accordingly, the state where electric power is supplied to the heat generation member 54*b*1 is achieved. At S106, the CPU 94 sets the Drive 1 signal to high (High), and sets the triac 56*a* in the turn-on state. Accordingly, electric power is supplied to the heater 54 (the heat generation member 54*b*1). At S107, the CPU 94 detects the step-down signal q1 after the zero-crossing signal is detected.

At S108, the CPU 94 determines whether or not the step-down signal q1 after detection of the zero-crossing signal was detected within ¼ of the time period of the cycle Tz, which is one full wave cycle of the AC voltage. At S108, in a case where the CPU 94 determines that the step-down signal q1 after detection of the zero-crossing signal was detected within ¼ of the time period of the cycle Tz, the processing proceeds to S117.

At S117, the CPU 94 determines whether or not the step-up signal q2 can be detected before detecting the next step-down signal, after the time obtained by subtracting 2.0 ms, which is a predetermined time period, from t2 calculated in S104 (t2−2.0 ms), from detection of the step-down signal q1. At S117, in a case where the CPU 94 determines that the step-up signal q2 can be detected, the processing proceeds to S118. In this case, the value is shown in the state where the heat generation member 54*b*2 is connected as the internal logic of the CPU 94 (FIG. 6A to FIG. 6C), in spite of being in the state of supplying power to the heat generation member 54*b*1. Therefore, at S118, the CPU 94 determines that one of the circuit and the fixing apparatus 50 is abnormal, and at S116, sets the Drive 1 signal to Low, sets the triac 56*a* in the turn-off state, cuts off power supply from the AC power supply 55 to the fixing apparatus 50, and ends the processing. In this manner, the CPU 94 determines an abnormality based on the zero-crossing signal output from the zero-crossing circuit unit 1100, and the determination result of the determination circuit unit 1200.

At S117, in a case where the CPU 94 determines that the step-up signal q2 cannot be detected within the above-described time period, the processing proceeds to S109. At S109, the CPU 94 sets the Drive 1 signal to Low, and sets the triac 56*a* in the turn-off state. At S108, in a case where the CPU 94 determines that the step-down signal q1 after detection of the zero-crossing signal cannot be detected within ¼ of the time period of the cycle Tz, the processing proceeds to S109. At S109, the CPU 94 sets the Drive 1 signal to Low, and sets the triac 56*a* in the turn-off state.

At S110, the CPU 94 sets the Drive 2 signal to High, and sets the relay 57*a* in the turn-on state. Accordingly, the state where electric power is supplied to the heat generation member 54*b*2 is achieved. At S111, the CPU 94 sets the Drive 1 signal to High again to turn on the triac 56*a*, and supplies electric power to the heater 54 (the heat generation member 54*b*2). At S112, similar to the processing in S107, the CPU 94 detects again the step-down signal q1 after detection of the zero-crossing signal.

At S113, the CPU 94 determines whether or not the step-down signal q1 after detection of the zero-crossing signal can be detected within ¼ of the time period of the cycle Tz. At S113, in a case where the CPU 94 determines that the step-down signal q1 after detection of the zero-crossing signal can be detected within ¼ of the time period of the cycle Tz, the processing proceeds to S114. At S114, the CPU 94 determines whether or not the step-up signal q2 can be detected before detecting the next step-down signal, after t2−2.0 ms from detection of the step-down signal q1.

At S113, in a case where the CPU 94 determines that the step-down signal q1 after detection of the zero-crossing signal cannot be detected within ¼ of the time period of the cycle Tz, the processing proceeds to S118. In this case, the value is shown in the state where the heat generation member 54*b*1 is connected as the internal logic of the CPU 94 (FIG. 5A to FIG. 5C), in spite of being in the state of supplying power to the heat generation member 54*b*2. At S118, the CPU 94 determines that one of the circuit and the fixing apparatus 50 is abnormal, and at S116, sets the Drive 1 signal to Low, sets the triac 56*a* in the turn-off state, cuts off power supply from the AC power supply 55 to the fixing apparatus 50, and ends the processing.

At S114, in a case where the CPU 94 determines that the step-up signal q2 before detecting the next step-down signal can be detected after elapse of t2−2.0 ms from detection of the step-down signal q1, the processing proceeds to S115. At S115, the CPU 94 determines that the circuit and the fixing apparatus 50 are normal. At S116, the CPU 94 sets the Drive 1 signal to Low, sets the triac 56*a* in the turn-off state, cuts off power supply from the AC power supply 55 to the fixing apparatus 50, and ends the processing. Note that, in a case where the CPU 94 determines that one of the circuit and the fixing apparatus 50 is abnormal at S118, the fixing apparatus 50 is not operated after the processing of FIG. 7 ends.

In Embodiment 1, in the turn-off state of the relay 57*a*, a current does not flow into the photocoupler 115. Accordingly, the internal logic of the CPU 94 remains in the High state. Then, in the flowchart of FIG. 7, the determination process in S108 becomes No, and a transition is made to the processing in S109. Additionally, in the turn-on state of the relay 57*a*, a current flows into the photocoupler 115 with a half wave having the phase opposite to the phase of a predetermined half wave with which the photocoupler 113 is operated (hereinafter referred to as the half wave opposite phase). When a current flows into the photocoupler 115, the internal logic of the CPU 94 transitions to the Low state, and the step-down signal q1 after detection of the zero-crossing signal is detected. Then, the step-down signal q2 is detected after t2 elapses from the step-down signal q1. Then, the determination in S113 becomes Yes, and the processing proceeds to the determination in S114. The determination in S114 becomes Yes, a transition is made to the processing in S115, and it is determined to be normal.

As described above, in the driving circuit configuration that switches power supply to the plurality of heat generation members 54*b* by using the c-contact relay, the photocoupler 115 is connected so that only the potential difference between predetermined heat generation members can be detected with the opposite phase of the photocoupler 113 for detection of the zero-crossing signal. The resistance is connected so that there is a difference between the value of the current flowing into the LED of the photocoupler 113 for zero-crossing signal detection, and the value of the current flowing into the LED of the photocoupler 115. Accordingly, by generating a difference between the turn-on time of the photocoupler 113 and the turn-on time of the photocoupler 115 so as to distinguish between the zero-crossing signal and the detection signal (q1, q2), the zero-crossing signal and the signals for determining power supply to the heat generation member 54*b* are detected with one signal line. Even if a part having a function equivalent to the function of the component in Embodiment 1 is used, such as using a thermopile instead of the thermistor used for the fixing temperature sensor 59, the effect of Embodiment 1 does not change.

In this manner, according to Embodiment 1, whether or not power supply is performed to the heater 54 is determined by a simple method while suppressing an increase in the cost, and a failure in the driving circuit is detected. By detecting a failure in the driving circuit, excessive heating of the fixing apparatus 50 can be prevented from happening, and fuming, ignition, etc. can be prevented from occurring. As described above, according to Embodiment 1, the heat generation member to which electric power is being supplied can be accurately determined from among the plurality of heat generation members by a simple way while suppressing an increase in the cost, excessive heating of the fixing apparatus can be prevented, and fuming, ignition, etc. of the fixing apparatus can be prevented from occurring.

Embodiment 2

In Embodiment 1, the configuration has been described in which the determination circuit unit 1200 is connected with the opposite phase of the zero-crossing circuit unit 1100 on the secondary side. In Embodiment 2, an embodiment of the configuration will be described in which a determination circuit unit 1201 is connected with the opposite phase of a zero-crossing circuit unit (a frequency detection circuit unit described below) on the primary side.

[Configuration and Operation of Frequency Detection Circuit Unit]

Figure 8:
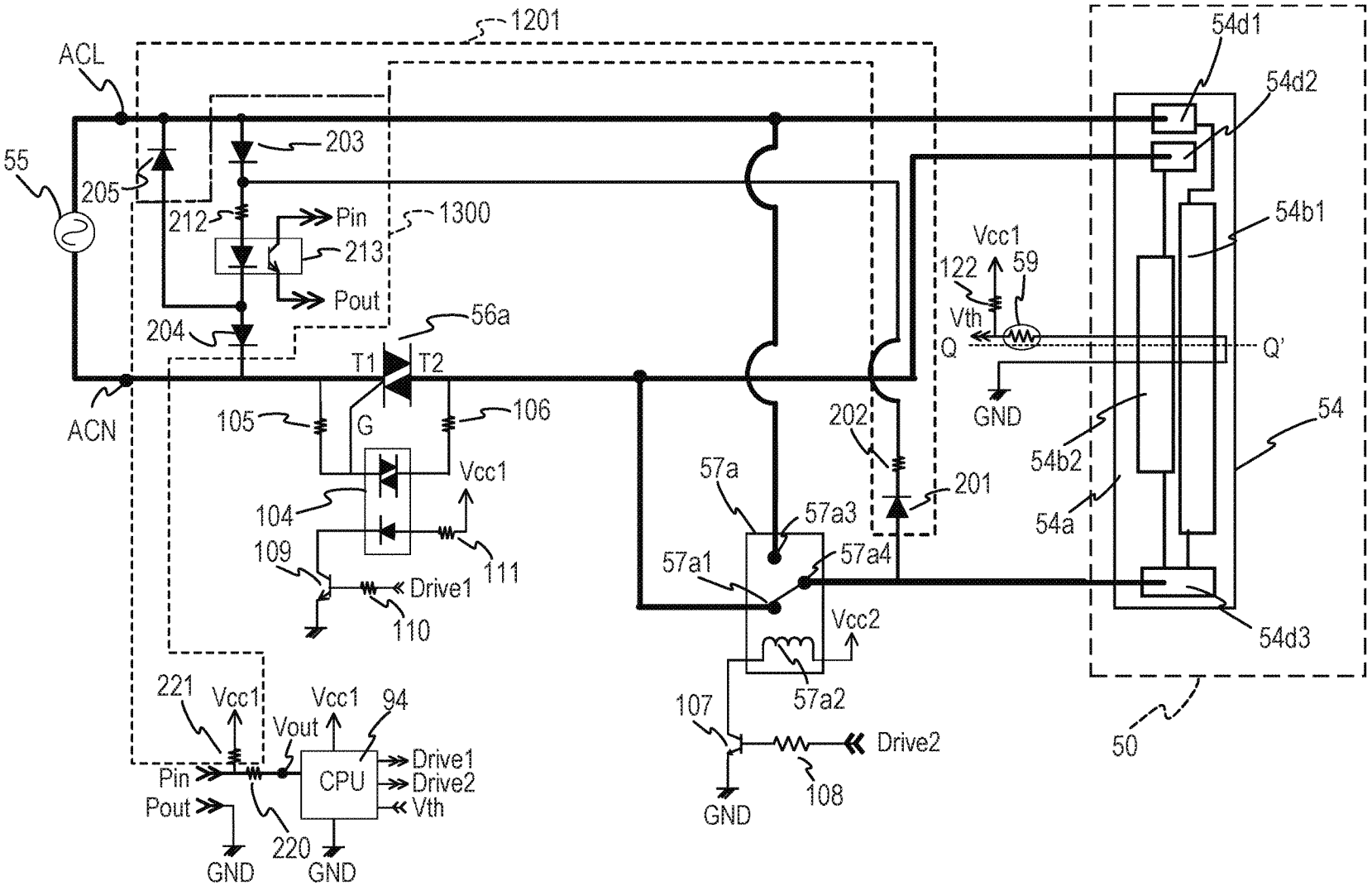
FIG. 8 is a general schematic diagram illustrating the circuit configuration of the fixing apparatus of Embodiment 2.

FIG. 8 is a general schematic diagram illustrating the circuit configuration of the fixing apparatus 50 of Embodiment 2. The configuration other than a frequency detection circuit unit 1300 and the determination circuit unit 1201 is the same as the configuration of Embodiment 1, and a description will be omitted. The circuit configuration that detects the frequency of the AC power supply 55 of Embodiment 2 will be described. In Embodiment 2, the frequency detection circuit unit 1300 that detects the frequency of the AC power supply 55 includes a resistance 212, a resistance 221, a photocoupler 213, a diode 203, and a diode 204. The anode of the diode 203 is connected to the first pole (the ACL portion) of the AC power supply 55, and the cathode is connected to one end of the resistance 212. The other end of the resistance 212 is connected to the anode of an LED of the photocoupler 213. The cathode of the LED of the photocoupler 213, which is a third photocoupler, is connected to the anode of the diode 204, and the cathode of the diode 204 is connected to the second pole (ACN) of the AC power supply 55.

The collector of a light-receiving side transistor of the photocoupler 213 is connected to one end of the resistance 221, and to one end of the resistance 220 (hereinafter referred to as the Pin portion). The other end of the resistance 221 is connected to the DC voltage Vcc1, which is +3.3 V. The emitter of the light-receiving side transistor of the photocoupler 213 is connected to the GND (hereinafter referred to as the Pout portion). The other end of the resistance 220 is connected to the CPU 94 (hereinafter referred to as the Vout portion).

Irrespective of the turn-on state and the turn-off state of the triac 56*a*, when the voltage having a constant value or more is supplied from the AC power supply 55, a current is supplied through the diode 203 and the resistance 212, and the LED of the photocoupler 213 emits light. When the LED of the photocoupler 213 emits light, a light reception current flows into the base of the light-receiving side transistor, the transistor of the photocoupler 213 is turned on, and a current flows into the collector. Hereinafter, this state is referred to as the turn-on state of the photocoupler 213. When the photocoupler 213 is turned on, a current flows into the resistance 221 through the DC voltage Vcc1, and an electric potential difference is generated between both ends of the resistance 221. With the potential difference generated between both ends of the resistance 221, the voltage of the Vout portion, which is an input terminal of the CPU 94, falls from the DC voltage Vcc1 to about 0.3 V, which is the same level as the collector to emitter voltage of the transistor of the photocoupler 213.

When the voltage of the AC power supply 55 falls to the constant value or less, a current does not flow into the LED of the photocoupler 213, a current also does not flow into the resistance 221, and the potential at the Vout portion rises to the same electric potential as the DC voltage Vcc1. Hereinafter, this state is referred to as the turn-off state of the photocoupler 213. The CPU 94 outputs the high-level Drive 1 signal after a defined period of time elapses, while using, as the reference, the timing at which the potential at the Vout portion rises from near 0 V to the same electric potential as the DC voltage Vcc1. Accordingly, by setting the triac 56*a* in one of the turn-on state and the turn-off state, electric power is supplied from the AC power supply 55 to the heater 54 or is cut off. The CPU 94 performs temperature control of the fixing apparatus 50 by controlling the triac 56*a* based on the temperature information detected by the fixing temperature sensor 59, and repeating power supply to the heater 54 and cutoff.

[Configuration of Determination Circuit Unit]

The configuration of the determination circuit unit 1201 of Embodiment 2 will be described. In addition to the frequency detection circuit unit 1300, the determination circuit unit 1201 of Embodiment 2 includes a resistance 202, a diode 201, and a diode 205. The anode of the diode 201 is connected to the contact 57*a*4 of the relay 57*a*, and to the contact 54*d*3 of the heater 54. The cathode of the diode 201 is connected to one end of the resistance 202. The other end of the resistance 202 is connected to the resistance 212 and the cathode of the diode 203. The anode of the diode 205 is connected to the cathode of the LED of the photocoupler 213, and the anode of the diode 204. The cathode of the diode 205 is connected to the first pole (the ACL portion) of the AC power supply 55.

[Operation of Determination Circuit]

Figure 9A:
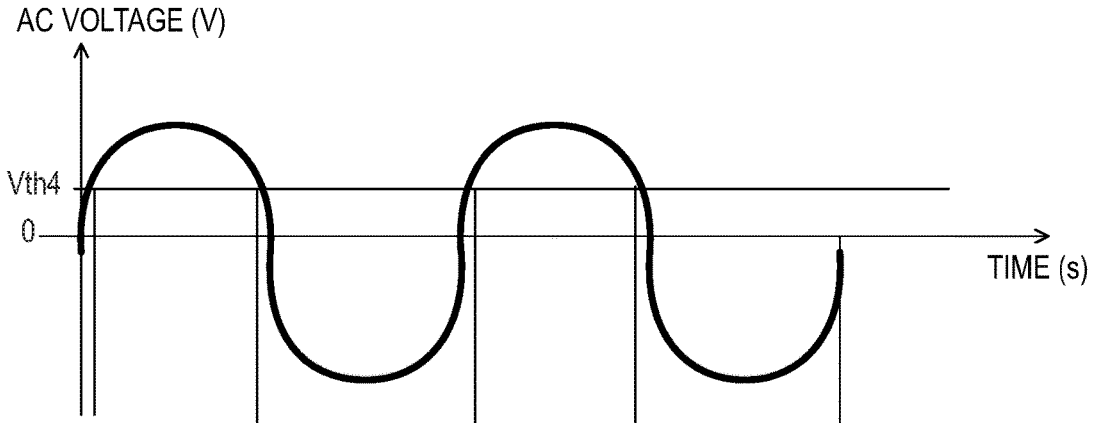
FIG. 9A, FIG. 9B and FIG. 9C are output voltage wave form charts of the AC voltage, the Vout portion, and the CPU internal logic of Embodiment 2, respectively.
Figure 9B:
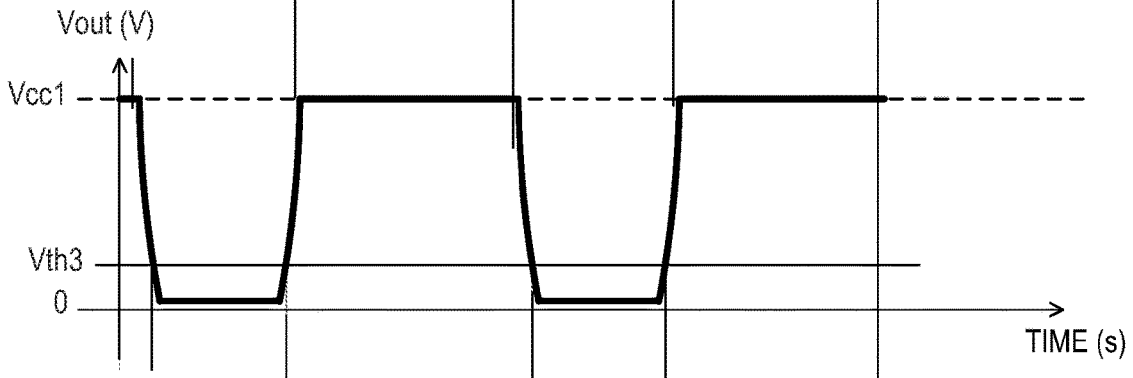
Figure 9C:
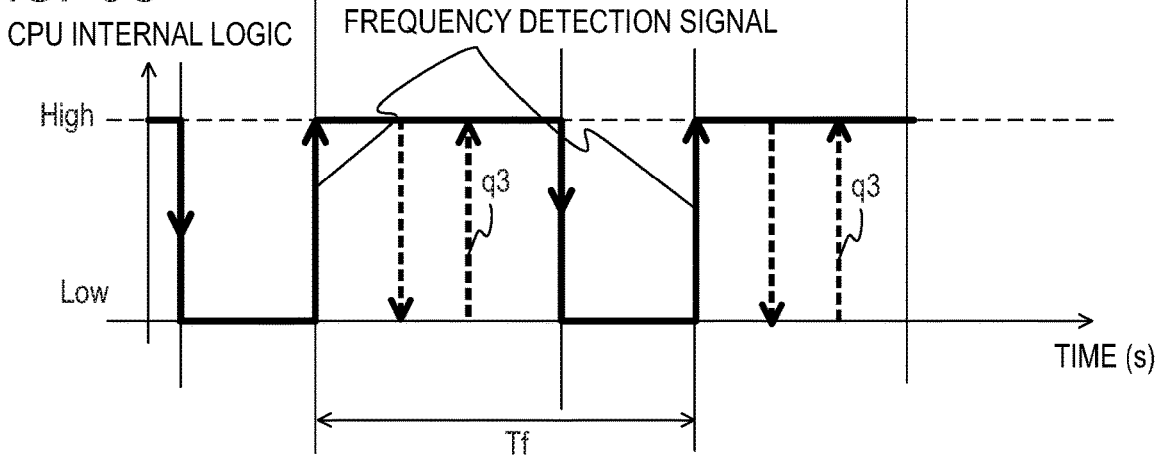
Figures 10A, 10B, 10C:
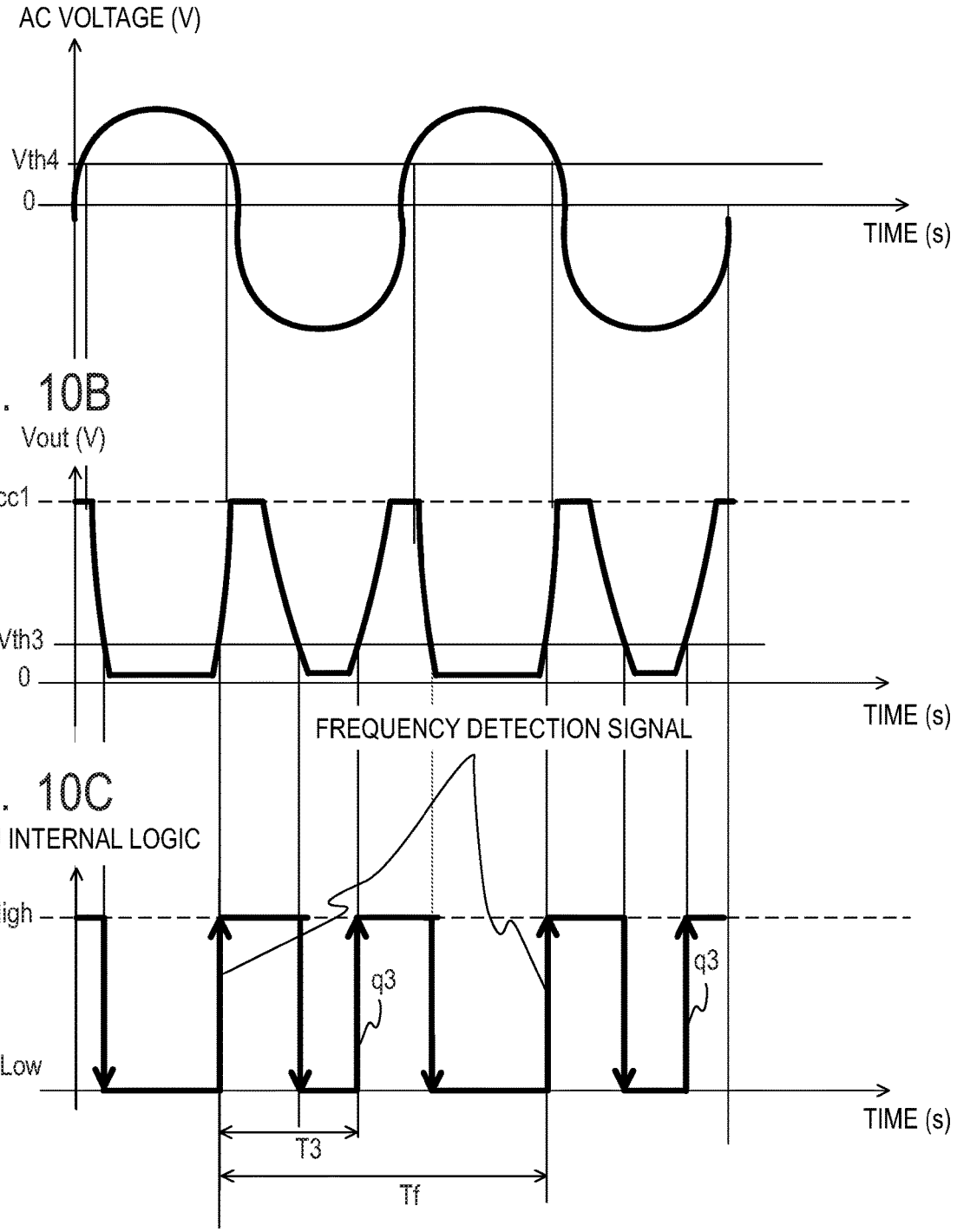
FIG. 10A, FIG. 10B and FIG. 10C are output voltage wave form charts of the AC voltage, the Vout portion, and the CPU internal logic of Embodiment 2, respectively.

FIG. 9A to FIG. 9C and FIG. 10A to FIG. 10C are graphs similar to those in FIG. 5A to FIG. 5C and FIG. 6A to FIG. 6C. Note that Vth4 illustrated in FIG. 9A and FIG. 10A is a light emitting threshold of the LED of the photocoupler 213. FIG. 9A to FIG. 9C are output waveform diagrams in the turn-on state of the relay 57*a* (the state where the contact 57*a*4 and the contact 57*a*3 are conducted) (the state where electric power is supplied to the heat generation member 54*b*2). FIG. 10A to FIG. 10C are output waveform diagrams in the turn-off state of the relay 57*a* (the state where the contact 57*a*4 and the contact 57*a*1 are conducted) (the state where electric power is supplied to the heat generation member 54*b*1).

(When Relay is in Turn-on State (Heat Generation Member 54*b*2 is Connected))

(ACL Portion>ACN Portion)

First, the operation in a case where the relay 57*a* is in the turn-on state (the state where the contact 57*a*4 and the contact 57*a*3 are conducted), and electric power is supplied to the heat generation member 54*b*2 will be described by using FIG. 9A to FIG. 9C. When the triac 56*a* is in the turn-on state with the Drive 1 signal of the CPU 94, electric power is supplied to the heater 54 from the AC power supply 55. When electric power is supplied to the heater 54 from the AC power supply 55, the voltage of the ACL portion becomes high with respect to the ACN portion, and in a case where a current flows into the ACN portion through the heater 54 from the ACL portion, the following occurs. That is, when the voltage of the ACL portion rises with respect to the ACN portion, and exceeds Vth4, which is a predetermined voltage, a current flows through the diode 203, the resistance 212, the LED of the photocoupler 213, and the diode 204 of the frequency detection circuit unit 1300 (this is also a zero-crossing circuit). In addition, a current flows through the diode 201, the resistance 202, the resistance 212, a light-emitting side LED of the photocoupler 213, and the diode 204. The LED of the photocoupler 213 emits light with both of the currents, and the photocoupler 213 is in the turn-on state. When the photocoupler 213 is turned on, a current flows into the resistance 221 through the DC voltage Vcc1, and an electric potential difference is generated between both ends of the resistance 221. With the voltage generated between both ends of the resistance 221, the voltage of the Vout portion, which is the input terminal of the CPU 94, falls from the DC voltage Vcc1 to about 0.3 V, which is the same level as Vce of a transistor 217. When a potential at the Vout portion is decreased from the DC voltage Vcc1 to about 0.3 V, the potential also becomes less than the internal logic threshold value Vth3 of the CPU 94, and the internal logic also transitions from the high (High) state to the low (Low) state.

(ACL Portion<ACN Portion)

When the voltage of the AC power supply 55 falls to the constant value or less, a current does not flow into the LED of the photocoupler 213, and a current also does not flow into the resistance 221, and the potential at the Vout portion rises to the same electric potential as the DC voltage Vcc1. Hereinafter, this state is referred to as the turn-off state of the photocoupler 213. When the potential at the Vout portion rises to the DC voltage Vcc1, the internal logic of the CPU 94 also transitions from the low state to the high state. Conversely, when electric power is supplied to the heater 54 from the AC power supply 55, the voltage of the ACN portion becomes high with respect to the ACL portion. In a case where a current flows into the ACL portion through the heater 54 from the ACN portion, the cathode potential becomes high with respect to the diode 204, the LED of the photocoupler 213, and the anode potential of the diode 203. Accordingly, since the voltage is applied in the reverse direction, a current does not flow into the light-emitting side LED of the photocoupler 213.

Additionally, in the turn-on state of the relay 57*a*, since the contact 57*a*3 and the contact 57*a*4 are short-circuited, and an electric potential difference is not generated between both ends of the diode 201, a current through the diode 201 also does not flow. Therefore, a current does not flow into the LED of the photocoupler 213, the photocoupler 213 is in the turn-off state, and the potential at the Vout portion has the same electric potential as the DC voltage Vcc1 that is being pulled up by the resistance 221. Here, it is assumed that the step-up signal detected at the timing when the CPU 94 transitions from the low (Low) state to the high (High) state is a frequency sensing signal.

The CPU 94 derives a time Tf until the next frequency sensing signal is detected after detecting the frequency sensing signal. Similar to Embodiment 1, it is assumed that the CPU 94 includes a timer (not illustrated), and measures the time, etc. with the timer. A frequency f of the AC power supply 55 is defined by f=1/Tf, and the CPU 94 calculates the frequency f of the AC power supply 55 after deriving the time Tf.

(When Relay is in Turn-off State (Heat Generation Member 54*b*1 is Connected))

(ACL Portion>ACN Portion)

Next, the operation in a case where the relay 57*a* is in the turn-off state (the state where the contact 57*a*1 and the contact 57*a*4 are connected), and electric power is supplied to the heat generation member 54*b*1 will be described by using FIG. 10A to FIG. 10C. When electric power is supplied to the heater 54 from the AC power supply 55, the voltage of the ACL portion becomes high with respect to the ACN portion, and in a case where a current flows into the ACN portion through the heater 54 from the ACL portion, the following occurs. That is, in the state where the contact 57*a*1 and the contact 57*a*4 are short-circuited in the turn-off state of the relay 57*a*, since an electric potential difference is generated in the reverse direction between both ends of the diode 201, a current does not flow into the diode 201. When the voltage of the ACL portion rises with respect to the ACN portion, and exceeds Vth4, which is the predetermined voltage, a current flows through the diode 203, the resistance 212, the LED of the photocoupler 213, and the diode 204 of the above-described frequency detection circuit unit 1300. With this current, the LED of the photocoupler 213 emits light, and is in the turn-on state.

When the photocoupler 213 is turned on, a current flows into the resistance 221 through the DC voltage Vcc1, and an electric potential difference is generated between both ends of the resistance 221. With the voltage generated between both ends of the resistance 221, the voltage of the Vout portion, which is the input terminal of the CPU 94, falls from the DC voltage Vcc1 to about 0.3 V, which is the same level as the collector to emitter voltage Vce of the transistor 217. When the potential at the Vout portion is decreased from the DC voltage Vcc1 to about 0.3 V, it becomes less than the internal logic threshold value of the CPU 94, and the internal logic also transitions from the high (High) state to the low (Low) state. When the voltage of the AC power supply 55 falls to the constant value or less, a current does not flow into the LED of the photocoupler 213, a current also does not flow into the resistance 221, and the potential at the Vout portion rises to the same electric potential as the DC voltage Vcc1. Hereinafter, this state is referred to as the turn-off state of the photocoupler 213. When the potential at the Vout portion rises to the DC voltage Vcc1, the internal logic of the CPU 94 also transitions from the Low state to the High state.

(ACL Portion<ACN Portion)

Conversely, when the triac 56*a* is in the turn-on state with the Drive 1 signal of the CPU 94, and electric power is supplied to the heater 54 from the AC power supply 55, in a case where the voltage of the ACN portion becomes high with respect to the ACL portion, the following occurs. That is, in a case where a current flows into the ACL portion through the heater 54 from the ACN portion side, the potential on the cathode side (the ACN portion) becomes high with respect to the anode side (the ACL portion) of the LED of the photocoupler 213. Since an electric potential difference is generated in the reverse direction of the LED of the photocoupler 213, the diode 204, and the diode 203 in a case where the potential on the cathode side (the ACN portion) becomes high with respect to the anode side (the ACL portion) of the LED of the photocoupler 213, a current does not flow.

On the other hand, a current flows from the diode 201 in such cases as follows. That is, a current flows when the voltage of the ACL portion exceeds the total value of the light emission voltage threshold value Vth4 of the LED of the photocoupler 213, and the threshold voltages of the diode 201 and the diode 205. A current flows through the diode 201, the resistance 202, the resistance 212, the light-emitting side LED of the photocoupler 213, and the diode 205, and a current flows into the LED of the photocoupler 213. When a current flows into the light-emitting side LED of the photocoupler 213, a voltage is generated across both ends of the resistance 221, and the potential of the Vout portion falls to about 0.3 V, which is the collector to emitter voltage of the transistor of the photocoupler 213.

When the voltage of the AC power supply 55 rises, and the potential of the Vout portion becomes less than the internal logic threshold value of the CPU 94, the internal logic also transitions from the high (High) state to the low (Low) state. When the voltage of the AC power supply 55 falls to the constant value or less, a current does not flow into the LED of the photocoupler 213, a current also does not flow into the resistance 221, and the potential at the Vout portion rises to the same electric potential as the DC voltage Vcc1. Hereinafter, this state is referred to as the turn-off state of the photocoupler 213. When the potential at the Vout portion rises to the DC voltage Vcc1, the internal logic of the CPU 94 also transitions from the low (Low) state to the high (High) state. Here, it is assumed that the signal with which the internal logic of the CPU 94 transitions from the low (Low) state to the high (High) state after the frequency detection signal is q3. Additionally, it is assumed that the cycle from the frequency detection signal to q3 is T3.

From the above, in a case where electric power is supplied to the heat generation member 54*b*2 in the turn-on state of the relay 57*a*, as illustrated in FIG. 9C, the transition of the internal logical value of the CPU 94, such as q3 indicated by broken-line arrows, does not occur. On the other hand, in a case where electric power is supplied to the heat generation member 54*b*1 in the turn-off state of the relay 57, as illustrated in FIG. 10C, the transition of the internal logical value of the CPU 94, such as q3 indicated by continuous-line arrows, occurs.

In Embodiment 2, the resistance 212 is 94 kΩ and the resistance 202 is 470 kΩ. The resistance value of the resistance 202, which is a fourth resistance, is larger than the resistance value of the resistance 212, which is a third resistance. When a sine wave voltage having AC100 V and 50 Hz as the maximum effective value is applied to the heat generation member 54*b* from the AC power supply 55, in the turn-on state of the relay 57*a*, Tf=about 20 ms. The cycle T3 from the frequency detection signal to q3 is calculated as the value obtained by multiplying the cycle Tf by a predetermined ratio that is defined in advance, and in Embodiment 2, T3=0.7×Tf, and thus T3=14 ms.

[Determination Method and Flowchart]

Figure 11:
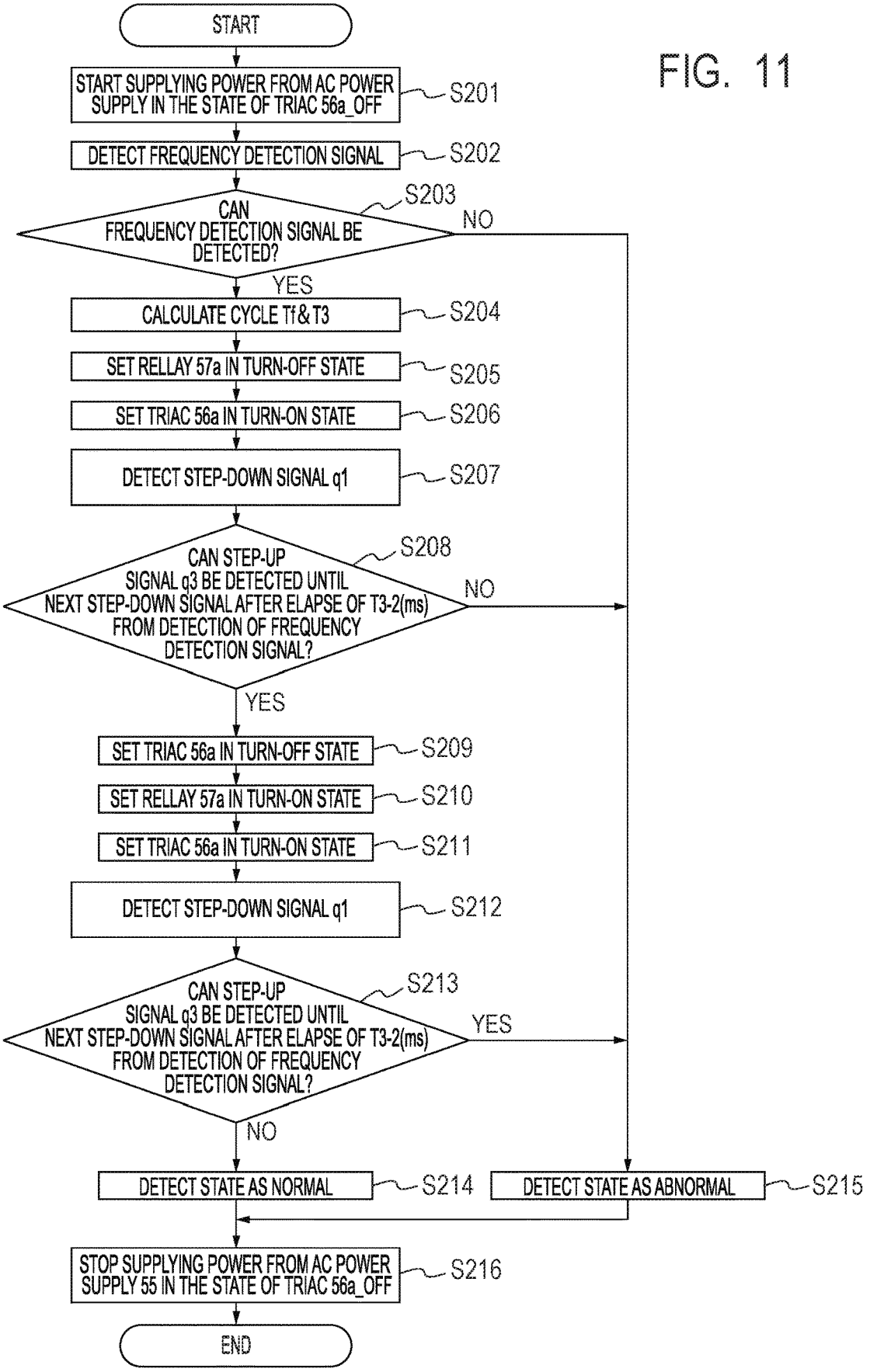
FIG. 11 is a flowchart illustrating the determination processing of the heat generation member to which the electric power is being supplied in Embodiment 2.

FIG. 11 is a flowchart illustrating a determination method and determination processing. As for the difference from Embodiment 1, in Embodiment 1, the signals q1 and q2 for determining power supply to the heat generation member 54*b*, and the zero-crossing signal are distinguished in the time t2 during which the CPU 94 is in the low state. On the other hand, Embodiment 2 is different in that the frequency is calculated from the cycle T2 between a rising portion and its next rising portion of the potential at the Vout portion, and the signal of the longer cycle Tf is determined to be the frequency of the AC power supply 55, and the signal of the shorter cycle T3 is determined to be a signal for determining power supply to the heat generation member 54*b*. Note that processing in S201 of FIG. 11 is the same as the processing in S101 of FIG. 7, and a description will be omitted.

At S202, the CPU 94 detects a frequency detection signal. When the CPU 94 detects a step-down signal, the CPU 94 detects a signal that rises from the next Low state to the High state after 4.0 ms from a step-down signal as the frequency detection signal (see FIG. 9C and FIG. 10C). After detecting the first frequency detection signal, the CPU 94 detects again the next step-up signal after 14 ms, which is a predetermined time period defined in advance, and uses the next step-up signal as the second frequency detection signal. Also in Embodiment 2, it is assumed that the CPU 94 measures the time with a timer (not illustrated).

At S203, the CPU 94 determines whether or not the frequency detection signal can be detected. At S203, in a case where the CPU 94 determines that the frequency detection signal cannot be detected, the processing proceeds to S215. At S215, the CPU 94 determines that one of the circuit and the fixing apparatus 50 is abnormal, and the processing proceeds to S216. Since the processing in S216 is the same as the processing in S116 of FIG. 7, a description will be omitted. At S203, in a case where the CPU 94 determines that the frequency detection signal can be detected, the processing proceeds to S204. At S204, the CPU 94 calculates the cycle Tf and the cycle T3. The CPU 94 derives the cycle Tf, which is the time difference between the first frequency detection signal and the second frequency detection signal, and calculates the cycle T3 by multiplying the cycle Tf by a predetermined value 0.7 defined in advance. The Processing in S205 and S206 is the same as the processing in S105 and S106 of FIG. 7, and a description will be omitted.

At S207, the CPU 94 detects the step-up signal q3 after detecting the frequency detection signal. At S208, the CPU 94 determines whether or not the step-up signal q3, which should be detected until the next step-down signal after T3−2.0 ms from the frequency detection signal, can be detected. At S208, in a case where the CPU 94 determines that the step-up signal q3 cannot be detected until the next step-down signal after T3−2.0 ms from the frequency detection signal, the processing proceeds to S215. In this case, the value is shown in the state where the heat generation member 54*b*2 is connected as the internal logic of the CPU 94 (FIG. 9A to FIG. 9C), in spite of being in the state of supplying electric power to the heat generation member 54*b*1 (the relay 57*a* OFF). Note that the processing in S215 is the same as the processing in S118 of FIG. 7, and a description will be omitted. In this manner, the CPU 94 determines an abnormality based on the frequency detected by the frequency detection circuit unit 1300, and the determination result of the determination circuit unit 1201.

At S208, in a case where the CPU 94 determines that the step-up signal q3 can be detected, the processing proceeds to S209. Note that the processing in S209 to S211 is the same as the processing in S109 to S111 of FIG. 7, and a description will be omitted. At S212, the CPU 94 detects the step-up signal q3, which is detected until the next step-down signal after T3−2.0 ms from the frequency detection signal. At S213, the CPU 94 determines whether or not the step-up signal q3 can be detected until the next step-down signal after T3−2.0 ms from the frequency detection signal. At S213, in a case where the CPU 94 determines that the step-up signal q3 can be detected, the processing proceeds to S215. In this case, the value is shown in the state where the heat generation member 54*b*1 is connected as the internal logic of the CPU 94 (FIG. 10A to FIG. 10C), in spite of being in the state of supplying electric power to the heat generation member 54*b*2 (the relay 57*a* ON). Since the processing in S215 has already been described, a description will be omitted. At S213, in a case where the CPU 94 determines that the step-up signal q3 cannot be detected, the processing proceeds to S214. At S214, the CPU 94 determines that the circuit and the fixing apparatus 50 are normal. Since the processing in S216 is the same as the processing in S116 of FIG. 7, a description will be omitted.

In Embodiment 2, it is assumed that in the turn-on state of the relay 57*a*, the relay 57*a* is normal, and the contact 57*a*3 and the contact 57*a*4 are in a short-circuited state. Additionally, it is assumed that the cycle Tf=about 20 ms, the frequency of the AC power supply 55 is 50 Hz, and the cycle T3=14 ms. Further, in the turn-off state of the relay 57*a*, the step-up signal g3 is detected until the next step-down signal after T3−2.0 ms from the frequency detection signal, i.e., after 12 ms from the frequency detection signal. Then, in the determination in S208 of FIG. 11, a transition is made to S209. In the turn-on state of the relay 57*a*, the step-up signal q3 is not detected. Then, in the determination in S213 of FIG. 11, a transition is made to S214, and it is determined to be normal.

As described above, in the driving circuit configuration that switches power supply to the plurality of heat generation members by using the c-contact relay, the diode and the resistance are additionally connected to the frequency detection circuit, so that a current flows only when electric power is supplied to a predetermined heat generation member. The resistance value is set so that the value of a current flowing into the LED of the photocoupler 213 for frequency detection changes only when electric power is supplied to a predetermined heat generation member. Then, the detection signals are distinguished by giving a difference between the cycle of the frequency detection signal, and the cycle at the time of detection of power supply to the heat generation member, and the frequency detection signal and the step-up signal (q3) are detected with one signal line. Even if a part having a function equivalent to the function of the component in Embodiment 2 is used, such as using a thermopile instead of the thermistor used for the fixing temperature sensor 59, the effect of Embodiment 2 does not change.

In this manner, according to Embodiment 2, whether or not power supply is performed to the predetermined heater 54 is determined by a simple method while suppressing an increase in the cost, and an abnormality in the heater 54 and the driving circuit unit is detected. By detecting an abnormality in the heater 54 and the driving circuit unit, excessive heating of the fixing apparatus 50 can be prevented from happening, and fuming, ignition, etc. can be prevented from occurring. As described above, according to Embodiment 2, the heat generation member to which electric power is being supplied can be accurately determined from among the plurality of heat generation members by a simple way while suppressing an increase in the cost, excessive heating of the fixing apparatus can be prevented, and fuming, ignition, etc. of the fixing apparatus can be prevented from occurring.

Embodiment 3

In Embodiment 1, the embodiment of the heater 54 including two kinds of a pair of heat generation members 54*b* has been described. In Embodiment 3, an embodiment of the heater 54 including three kinds of heat generation members 54*b* will be described. The zero-crossing circuit unit 1100 and the determination circuit unit 1200 are the same as those of Embodiment 1, and a description will be omitted in Embodiment 3. Note that, in the determination circuit unit 1200 of Embodiment 3, the COMMON portion is connected to one end of the resistance 114, and the NO portion is connected to the cathode of a primary side LED of the photocoupler 115.

[Description of Driving Circuit]

Figures 12A, 12B:
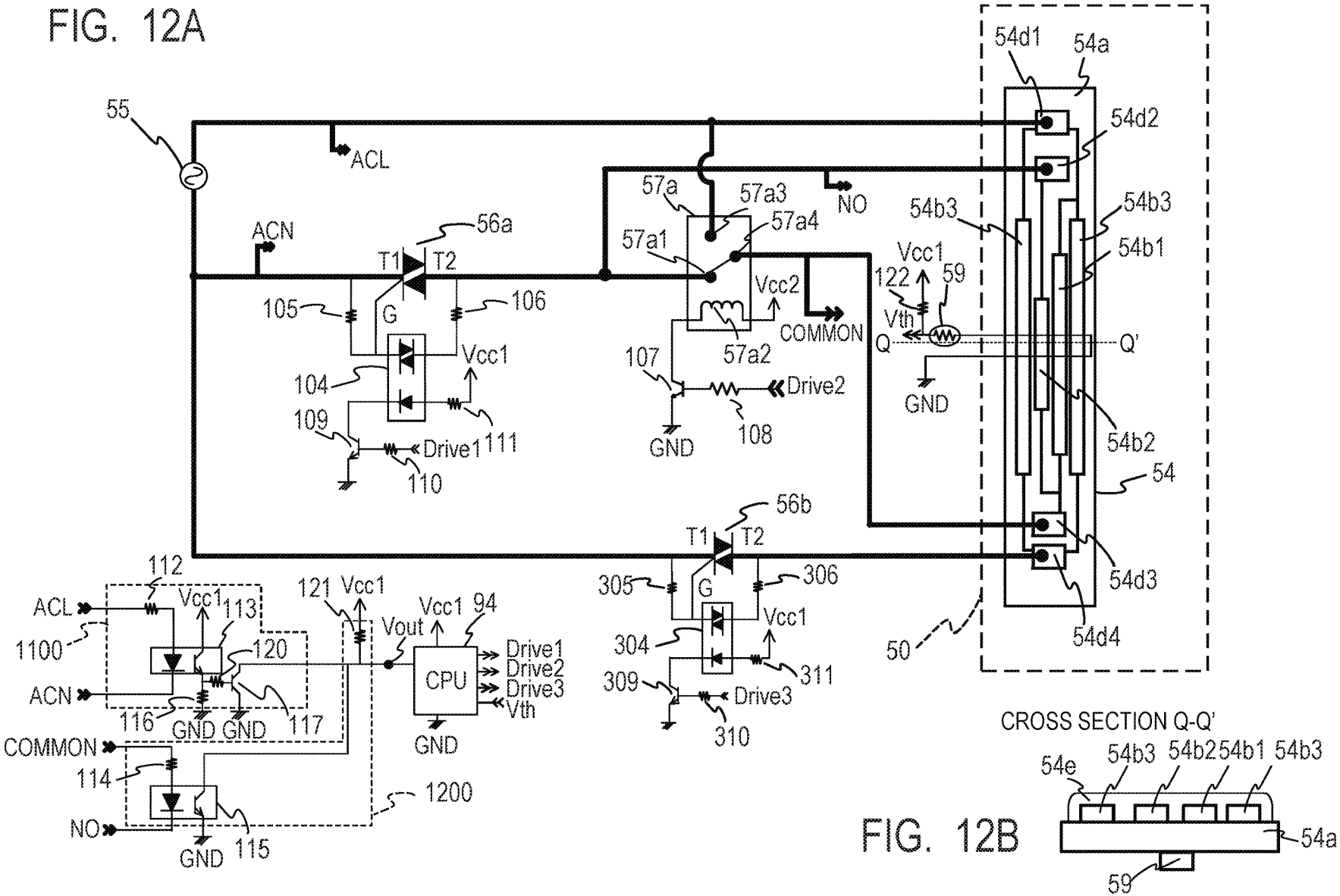
FIG. 12A is a general schematic diagram illustrating the circuit configuration of the fixing apparatus of Embodiment 3.
FIG. 12B is a cross-sectional view of the heater of the fixing apparatus of Embodiment 3.

FIG. 12A is a general schematic diagram illustrating the circuit configuration of the fixing apparatus 50. Embodiment 3 is different from Embodiment 1 in that the heater 54 includes two heat generation members 54*b*1 and 54*b*2 in Embodiment 1, whereas the heater 54 requires three heat generation members 54b1, 54b2 and 54b3 in Embodiment 3. The other configuration is the same as that of Embodiment 1, and a description will be omitted.

The heater 54 in the fixing apparatus 50 mainly includes heat generation members 54b1, 54b2 and 54b3 formed on the substrate 54a. Additionally, the heater 54 includes the contact 54d1, which is a fourth contact, 54d2, which is a third contact, 54d3, which is the first contact, and 54d4, which is the second contact. The heat generation members 54b1, 54b2 and 54b3 are resistors that receive power supply from the AC power supply 55, and generate heat. The heat generation members 54b3 are the heat generation members mainly used when fixing a toner to a recording paper having the maximum paper width for which sheet feeding can be performed in the fixing apparatus 50. Therefore, the longitudinal size of the heat generation member 54b3 is set to be longer than the sheet width 215.9 mm of the LTR size by about several millimeters. Additionally, the heat generation members 54b3 are the heat generation members mainly used at the time of start-up of the fixing apparatus 50 (when the fixing apparatus 50 rises from a cold state to a predetermined temperature), and is designed to be able to supply electric power required at the time of start-up of the fixing apparatus 50.

The heat generation members 54b3 are connected to the contact 54d1 and the contact 54d4. The heat generation member 54b1 is the heat generation member corresponding to the sheet width of the B5 size, and the longitudinal size of the heat generation member 54b1 is set to be longer than the sheet width 182 mm of the B5 size by about several millimeters. The heat generation member 54b1 is connected to the contact 54d1 and the contact 54d3. The heat generation member 54b2 is the heat generation member corresponding to the sheet width of the A5 size, and the longitudinal size of the heat generation member 54b2 is set to be longer than the sheet width 148 mm of the A5 size by about several millimeters. The heat generation member 54b2 is connected to the contacts 54d2 and 54d3. It is assumed that the heat generation members 54b1 and 54b2 are used in the state where the fixing apparatus 50 is warmed up to some extent, and the nominal powers of the heat generation members 54b1 and 54b2 are set to be lower than the nominal power of the heat generation member 54b3. In short, the heat generation members 54b3 serve as main heaters, and the heat generation members 54b1 and 54b2 serve as sub heaters. Accordingly, the main heaters (the heat generation members 54b3) and the sub heaters (the heat generation members 54b1 and 54b2) are used while being switched, mainly at the times of start-up and a load change. The contact 54d4 to which the heat generation members 54b3 are connected is connected to the second pole (the ACN portion) of the AC power supply 55 through the triac 56b.

FIG. 12B is a cross-sectional view illustrating the cross section obtained by cutting the heater 54 of the fixing apparatus 50 with a Q-Q' line illustrated in FIG. 12A. The fixing temperature sensor 59, which is the temperature detection unit, is installed on a surface opposite to the surface of the substrate 54a on which the heat generation members 54b3, 54b1 and 54b2 are installed, in the range through which the sheet P having the minimum sheet width for which paper feeding can be performed passes. Note that a thermistor is used for the fixing temperature sensor 59 in Embodiment 3. The cover glass layer 54e is provided in order to insulate the heat generation members 54b1, 54b2 and 54b3 having substantially the same electric potential as the AC power supply 55 from the user. The heat generation members 54b1 and 54b2 are provided between the two heat generation members 54b3 in the width direction of the substrate 54a. Additionally, Embodiment 3 includes the relay 57a, which is a first relay.

As illustrated in FIG. 12B, the fixing temperature sensor 59 contacts and installed in the substrate 54a, and detects the temperatures of the heat generation members 54b3, 54b1 and 54b2 through the substrate 54a. One end of the fixing temperature sensor 59 is connected to a resistance 122, and the other end is connected to GND. Then, the voltage Vth, which is obtained by dividing the DC voltage Vcc1 by the fixing temperature sensor 59 and the resistance 122, is input to the CPU 94.

The CPU 94 controls the triac 56a and the triac 56b, which are the second switching units, so that the fixing temperature sensor 59 becomes the target temperature defined in advance, based on the temperature information corresponding to the input voltage Vth. The operation of the triac 56b is the same as that of the triac 56a of Embodiment 1. When the CPU 94 outputs a high-level Drive 3 signal, a base current flows into the base terminal of a transistor 309 through a base resistance 310, and accordingly, the transistor 309 is turned on, and a collector current flows. When the collector current of the transistor 309 flows, a light emitting diode of a phototriac coupler 304 is in a conduction state, a current flows through a resistance 311 and the light emitting diode emits light, and a light receiving portion of the phototriac coupler 304 is in the conduction state. Resistances 305 and 306 are current limiting resistors.

The CPU 94 controls the triac 56b by the Drive 3 signal, based on the temperature information detected by the fixing temperature sensor 59 at the time of start-up of the fixing apparatus 50 (when the fixing apparatus 50 rises from the cold state to the predetermined temperature). The CPU 94 performs power supply to the heat generation member 54b3 from the AC power supply 55. After the fixing apparatus 50 rises to the predetermined temperature, the CPU 94 controls the relay 57a based on the paper width information of the sheet P, and switches the heat generation member to which electric power is supplied. Then, the CPU 94 controls the triac 56a and the triac 56b based on the temperature information detected by the fixing temperature sensor 59, and performs temperature control of the fixing apparatus 50.

[Determination Method and Flowchart]

Figure 13:
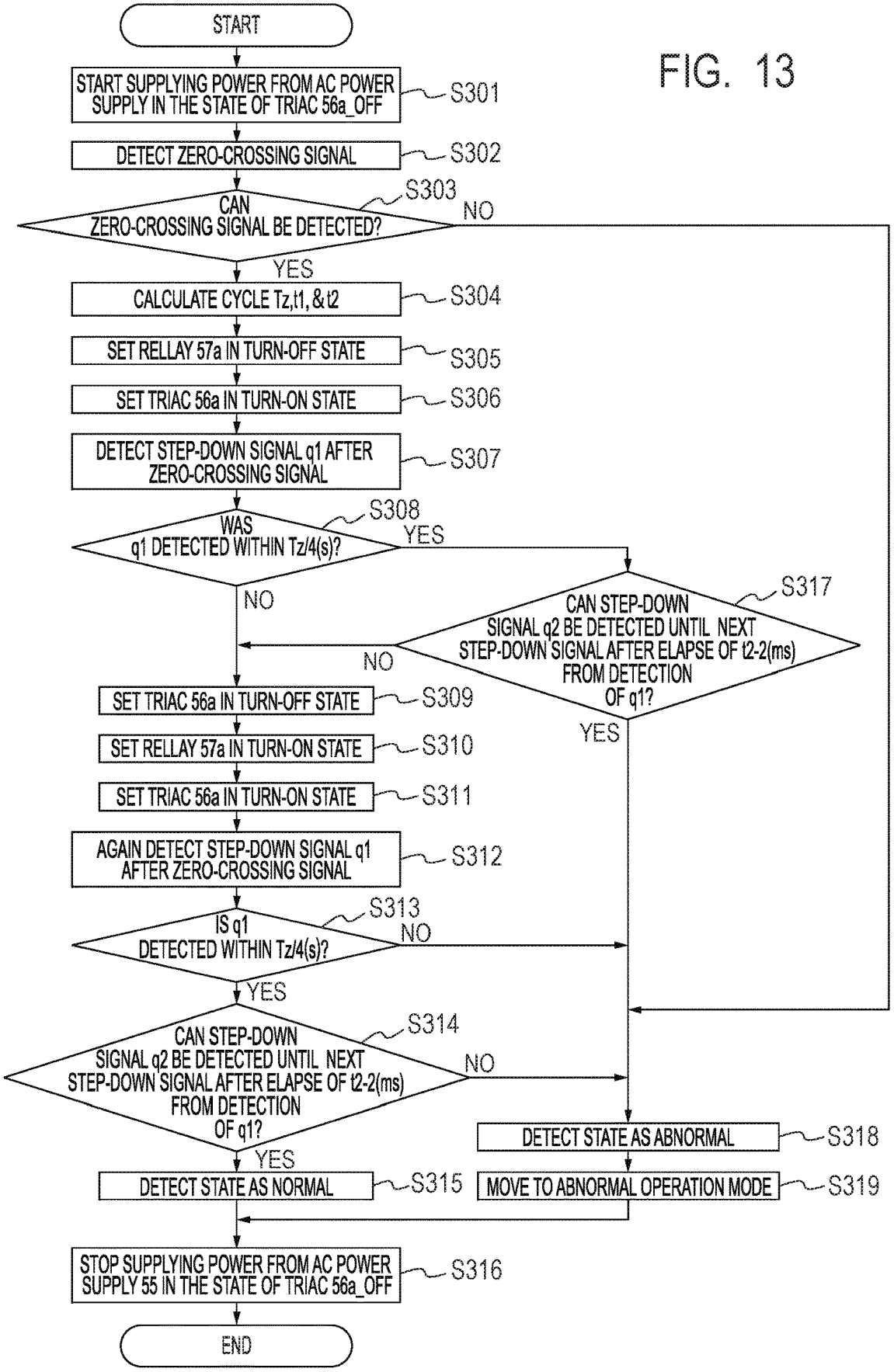
FIG. 13 is a flowchart illustrating the determination processing of the heat generation member to which the electric power is being supplied in Embodiment 3.

FIG. 13 is a flowchart illustrating a determination method and determination processing of Embodiment 3. The difference from Embodiment 1 is that, in Embodiment 1, control is ended after determining that there is an abnormality. On the other hand, Embodiment 3 is different in that, after detecting the abnormality, control is ended after operating an abnormal operational mode that controls the fixing apparatus 50 only by the heat generation member 54b3. Other than that, it is the same as Embodiment 1.

FIG. 13 is a flowchart illustrating a determination method and determination processing of power supply to the heat generation member 54b. Note that the processing in S301 to S318 is almost the same processing as the processing in S101 to S118 of FIG. 7, and processing different from that in Embodiment 1 will be described. In Embodiment 3, in a case where the CPU 94 determines that there is an abnormality in S318, the CPU 94 moves to the abnormal operational mode in S319. Specifically, the CPU 94 always sets the Drive 2 signal in the Low state, and stops control of the triac 56a. The CPU 94 controls the triac 56b with the Drive 3 signal, performs temperature control of the heater 54 only with the heat generation members 54b3, and lets the fixing apparatus 50 continue the operation. After making a transition to the abnormal operational mode, the CPU 94 proceeds the processing to S316.

In Embodiment 3, suppose the relay 57*a* is in a failed state, and in the state where the contacts 57*a*1 and 57*a*4 are short-circuited also in the turn-on state as in the turn-off state. In this case, in S308 of FIG. 13, the relay 57*a* remains in the state where the contacts 57*a*1 and 57*a*4 are short-circuited, the step-down signal q1 is detected, the processing proceeds to S317, and q2 is also detected. When it is determined that q2 is detected in the processing of S317, the CPU 94 determines that there is an abnormality in S318, and transitions to the abnormal operational mode in S319. The CPU 94 sets the Drive 1 signal to Low, sets the triac 56*a* in the turn-off state, cuts off power supply to the fixing apparatus 50 from the AC power supply 55 with a control circuit (not illustrated), and ends the processing.

Subsequently, the CPU 94 controls the triac 56*b* with the Drive 3 signal while continuing reporting of, for example, an abnormality alarm signal, and lets the fixing apparatus 50 continue the operation while performing temperature control of only the heat generation members 54*b*3. As described above, in the driving circuit configuration that switches power supply to the plurality of heat generation members by using the c-contact relay, the photocoupler 115 is connected so that only the electric potential difference of a predetermined heat generation member can be detected with the opposite phase of the photocoupler 113 for zero-crossing-signal detection. The resistance is connected so that there is a difference between the value of the current flowing into the LED of the photocoupler 113 for zero-crossing signal detection, and the value of the current flowing into the photocoupler 115. In this manner, by giving a difference between the ON operation times of the photocouplers so as to distinguish between the zero-crossing signal and the signal for determining power supply to the heat-generation-member (q1, q2), the zero-crossing signal and the power supply determination signal of the heat generation member are detected with one signal line. Even if a part having a function equivalent to the function of the component in Embodiment 3 is used, such as using a thermopile instead of the thermistor used for the fixing temperature sensor 59, the effect of Embodiment 3 does not change. Additionally, the heater (the heat generation members 54*b*1, 54*b*2, and 54*b*3) of Embodiment 3 may be applied to the circuit using the frequency detection signal and the signal q3 of Embodiment 2.

As described above, whether or not power supply is performed to the predetermined heater 54 is determined by a simple method while suppressing an increase in the cost, and an abnormality in the heater 54 and the driving circuit unit is detected. Fuming, ignition, etc. can be prevented by detecting an abnormality in the heater 54 and the driving circuit unit, and performing control such that the driving circuit unit with the abnormality is not used, so as to prevent excessive heating of the fixing apparatus 50. As described above, according to Embodiment 3, the heat generation member to which electric power is being supplied can be accurately determined from among the plurality of heat generation members by a simple way while suppressing an increase in the cost, excessive heating of the fixing apparatus can be prevented, and fuming, ignition, etc. of the fixing apparatus can be prevented from occurring.

According to the present invention, the heat generation member to which electric power is being supplied can be determined from among the plurality of heat generation members, and excessive heating of the fixing apparatus can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-043987, filed Mar. 11, 2019, which is hereby incorporated by reference herein in its entirety.

What is claimed is:

1. A fixing apparatus configured to fix an unfixed toner image on a recording material, the fixing apparatus comprising:

a heater unit including heat generation members at least including a first heat generation member having a first resistance value, and a second heat generation member having a second resistance value larger than the first resistance value;

a first switching unit configured to switch connection between one of the first heat generation member and the second heat generation member, and an AC power supply;

a second switching unit configured to be switchable between a conduction state in which electric power is supplied to one of the first heat generation member and the second heat generation member from the AC power supply, and a non-conduction state in which supply of electric power supplying to the one of the first heat generation member and the second heat generation member from the AC power supply is cut off;

a zero-crossing circuit unit connected between a first pole and a second pole of the AC power supply, the zero-crossing circuit unit configured to output a zero-crossing signal according to an AC voltage of the AC power supply; and a control unit configured to control the first switching unit and the second switching unit, wherein the control unit determines whether the electric power is supplied to the first heat generation member from the AC power supply, or the electric power is supplied to the second heat generation member from the AC power supply, based on the zero-crossing signal output from the zero-crossing circuit unit.

2. A fixing apparatus according to claim 1, comprising a determination circuit unit connected between the first switching unit and one end of one of the first heat generation member and the second heat generation member, and between the second switching unit and another end of the second heat generation member, and configured to determine that electric power is being supplied to either one of the first heat generation member and the second heat generation member.

3. A fixing apparatus according to claim 2, wherein the zero-crossing circuit unit includes a first photocoupler including a primary side diode and a secondary side transistor, and a first resistance connected to an anode of the primary side diode, wherein the determination circuit unit includes a second photocoupler including a primary side diode and a secondary side transistor, and a second resistance connected to an anode of the primary side diode, and wherein a resistance value of the second resistance is larger than a resistance value of the first resistance.

4. A fixing apparatus according to claim 3, wherein the first photocoupler is configured to be conducted in a case of a predetermined half wave of the AC voltage, and wherein the second photocoupler is configured to be conducted in a case of a half wave having an opposite phase of the predetermined half wave.

5. A fixing apparatus according to claim 4, wherein the determination circuit unit outputs a signal different from the zero-crossing signal in the case of the half wave having the opposite phase.

6. A fixing apparatus according to claim 5, wherein in a case where the first switching unit is controlled so that the first heat generation member is connected to the AC power supply, the control unit determines that there is an abnormality when the signal different from the zero-crossing signal in the case of the half wave having the opposite phase is output from the determination circuit unit.

7. A fixing apparatus according to claim 6, wherein in a case where the first switching unit is controlled so that the second heat generation member is connected to the AC power supply, the control unit determines that there is an abnormality when the signal different from the zero-crossing signal in the case of the half wave having the opposite phase is not output from the determination circuit unit.

8. A fixing apparatus according to claim 1, wherein the heater unit includes at least two third heat generation members, and a first contact, a second contact, a third contact, and a fourth contact to which ends of the first heat generation member, the second heat generation member, and the at least two third heat generation members are connected, wherein one end of the first heat generation member and one end of the second heat generation member are connected to the first contact, and one ends of the at least two third heat generation members are connected to the second contact, wherein another end of the second heat generation member is connected to the third contact, and wherein another end of the first heat generation member and another ends of the at least two third heat generation members are connected to the fourth contact.

9. A fixing apparatus according to claim 8, wherein the first switching unit includes a first relay, and wherein the first relay is configured to switch one of connection between the AC power supply and the first contact, and connection between the AC power supply and the third contact.

10. A fixing apparatus according to claim 8, comprising a substrate on which the first heat generation member, the second heat generation member, and the at least two third heat generation members are formed, wherein one of the at least third heat generation member, the first heat generation member, the second heat generation member, and another one of the at least two third heat generation member are arranged in this order in a width direction of the substrate.

11. A fixing apparatus according to claim 1, comprising:

a first rotary member configured to be heated by the heater unit; and a second rotary member configured to form a nip portion with the first rotary member.

12. A fixing apparatus according to claim 11, wherein the first rotary member is a film.

13. A fixing apparatus according to claim 12, wherein the heater unit is provided so as to contact an inner surface of the film, and wherein the nip portion is formed by the heater unit and the second rotary member through the film.

14. An image forming apparatus comprising:

an image formation unit configured to form an unfixed toner image on a recording material; and a fixing apparatus according to claim 1.

15. A fixing apparatus configured to fix an unfixed toner image on a recording material, the fixing apparatus comprising:

a heater unit including heat generation members at least including a first heat generation member having a first resistance value, and a second heat generation member having a second resistance value larger than the first resistance value;

a first switching unit configured to switch connection between one of the first heat generation member and the second heat generation member, and an AC power supply;

a second switching unit configured to be switchable between a conduction state in which electric power is supplied to one of the first heat generation member and the second heat generation member from the AC power supply, and a non-conduction state in which supply of electric power supplying to the one of the first heat generation member and the second heat generation member from the AC power supply is cut off;

a frequency detection circuit unit connected between a first pole and a second pole of the AC power supply, and configured to detect a frequency of an AC voltage of the AC power supply; and a control unit configured to control the first switching unit and the second switching unit, wherein the control unit determines whether the electric power is supplied to the first heat generation member from the AC power supply, or the electric power is supplied to the second heat generation member from the AC power supply, based on the frequency detected from the frequency detection circuit unit.

16. A fixing apparatus according to claim 15, comprising a determination circuit unit including the frequency detection circuit unit, connected between the first switching unit and one end of one of the first heat generation member and the second heat generation member, and between the first pole and another end of the first heat generation member, and configured to determine that electric power is supplied to either one of the first heat generation member and the second heat generation member.

17. A fixing apparatus according to claim 16, wherein the frequency detection circuit unit includes a photocoupler including a primary side diode and a secondary side transistor, and a first resistance connected to an anode of the primary side diode, wherein the determination circuit unit includes a diode, and a second resistance connected to a cathode of the diode, and wherein a resistance value of the second resistance is larger than a resistance value of the first resistance.

18. A fixing apparatus according to claim 17, wherein the frequency detection circuit unit is configured to conduct the photocoupler in a case of a predetermined half wave of the AC voltage, and wherein the determination circuit unit is configured to conduct the photocoupler in a case of a half wave having an opposite phase of the predetermined half wave.

19. A fixing apparatus according to claim 18, wherein in a case where the first switching unit is controlled so that the second heat generation member is connected to the AC power supply, the control unit determines that there is an abnormality when a signal different from a signal output from the frequency detection circuit unit in the case of the half wave having the opposite phase is output from the determination circuit unit.

20. A fixing apparatus according to claim 19, wherein in a case where the first switching unit is controlled so that the first heat generation member is connected to the AC power supply, the control unit determines that there is an abnormality when a signal different from a signal output from the frequency detection circuit unit in the case of the half wave having the opposite phase is not output from the determination circuit unit.

21. A fixing apparatus according to claim 15, wherein the heater unit includes at least two third heat generation members, and a first contact, a second contact, a third contact, and a fourth contact to which ends of the first heat generation member, the second heat generation member, and the at least two third heat generation members are connected, wherein one end of the first heat generation member and one end of the second heat generation member are connected to the first contact, and one ends of the at least two third heat generation members are connected to the second contact, wherein another end of the second heat generation member is connected to the third contact, and wherein another end of the first heat generation member and another ends of the at least two third heat generation members are connected to the fourth contact.

22. A fixing apparatus according to claim 21, comprising a substrate on which the first heat generation member, the second heat generation member, and the at least two third heat generation members are formed, wherein one of the at least two third heat generation member, the first heat generation member, the second heat generation member, and another one of the at least two third heat generation member are arranged in this order in a width direction of the substrate.

23. An image forming apparatus comprising:

an image formation unit configured to form an unfixed toner image on a recording material; and a fixing apparatus according to claim 15.

* * * * *